US005090827A

United States Patent [19]

Hirano et al.

[11] Patent Number: 5,090,827

[45] Date of Patent: Feb. 25, 1992

[54] MECHANISM FOR MOVING THERMAL HEAD ON CARRIAGE

[75] Inventors: Hirofumi Hirano, Yokohama; Akihiko Sukigara, Tokyo, both of Japan

[73] Assignee: Canon Kabushiki Kaisha, Tokyo, Japan

[21] Appl. No.: 581,081

[22] Filed: Sep. 11, 1990

Related U.S. Application Data

[63] Continuation of Ser. No. 133,385, Dec. 15, 1987, abandoned.

[30] Foreign Application Priority Data

| | | | |
|---|---|---|---|
| Dec. 27, 1986 | [JP] | Japan | 61-312655 |
| Dec. 27, 1986 | [JP] | Japan | 61-312661 |
| Dec. 27, 1986 | [JP] | Japan | 61-312662 |
| Dec. 27, 1986 | [JP] | Japan | 61-312663 |
| Dec. 27, 1986 | [JP] | Japan | 61-312664 |
| Dec. 27, 1986 | [JP] | Japan | 61-312665 |

[51] Int. Cl.[5] ..... B41J 25/308

[52] U.S. Cl. ..... 400/185; 400/120; 400/229; 400/320

[58] Field of Search ..... 400/120, 185, 187, 229, 400/248, 320, 634, 636, 641, 659, 662, 322, 328

[56] References Cited

U.S. PATENT DOCUMENTS

| | | | |
|---|---|---|---|
| 4,332,492 | 6/1982 | Thern et al. | 400/320 |
| 4,444,521 | 4/1984 | Rickard et al. | 400/120 |
| 4,526,486 | 7/1985 | Kikuchi et al. | 400/185 |
| 4,531,849 | 7/1985 | Dobashi | 400/229 |
| 4,538,931 | 9/1985 | Nagashima | 400/185 |
| 4,733,250 | 3/1988 | Nozaki et al. | 346/76 PH |
| 4,739,341 | 4/1988 | Matsuro et al. | 400/120 X |
| 4,750,007 | 6/1988 | Suzuki | 400/248 |
| 4,752,786 | 6/1988 | Inoue et al. | 400/185 X |

FOREIGN PATENT DOCUMENTS

| | | | |
|---|---|---|---|
| 101483 | 8/1980 | Japan | 400/636 |
| 148677 | 9/1982 | Japan | 400/120 |
| 87085 | 5/1985 | Japan | 400/120 |
| 151089 | 8/1985 | Japan | 400/198 |
| 54972 | 3/1986 | Japan | 400/120 |
| 1289394 | 9/1972 | United Kingdom | 400/320 |
| 2047173 | 9/1972 | United Kingdom . | |
| 1527482 | 10/1978 | United Kingdom . | |
| 2151557 | 7/1985 | United Kingdom . | |

OTHER PUBLICATIONS

Product Engineering, Oct. 26, 1959, pp. 71-75, "18 Ways to Control Backlash in Gearing", by Gutmann.

*Primary Examiner*—David A. Wiecking

*Attorney, Agent, or Firm*—Fitzpatrick, Cella, Harper & Scinto

[57] ABSTRACT

In a printer with reciprocating carriage, a motor mounted on the carriage is used for up-down motion of the recording head, reciprocating motion of the carriage and sheet feeding motion so that the printer can be made compact and less expensive. The carriage engages with the sheet driving mechanism when it is positioned at the left end position to advance the recording sheet.

24 Claims, 20 Drawing Sheets

1
2
2a
2b
2c
2d
2e
3
3a
4
4a
4b
4c
4d
5
6
6a
6b
7
8
9
10
11
12
13
13a
14
15
15a
15b
15c
15d
16
16g
17
17a
18
18a
18b
19
20
21
21a
21b
22
50
55
63
70
70d
71a
80(80a,80b)
101
101a
101b
101c
102
103
103a
104a
104b
104c
105
105a
501b
804
809
C
L ( EMBODIMENT 2 )

( EMBODIMENT 3 )

( EMBODIMENT 1 )

MECHANISM FOR MOVING THERMAL HEAD ON CARRIAGE

This application is a continuation of application Ser. No. 07/133,385 filed Dec. 15, 1987, now abandoned.

BACKGROUND OF THE INVENTION

1. Field of the Invention

The present invention relates to a printer for use in an electronic typewriter, facsimile apparatus, personal computer, word processor or the like, and more particularly to a serial printer in which a recording head reciprocates along a platen.

2. Description of the Related Background Art

In conventional printers there are provided motors respectively for up-down motion of the recording head and for reciprocating a carrier, supporting the recording head, along a platen.

The presence of such plural motors in the conventional printers has inevitably increased the dimension thereof.

Also it is proposed, in the conventional printers, to use a single motor both for the up-down motion of the recording head and for the reciprocating motion of the carrier. However such printers require a solenoid, plunger or the like as a switching mechanism in the transmission of a driving force, and are therefore inevitably large.

SUMMARY OF THE INVENTION

An object of the present invention is to provide a compact printer not requiring a large installation space.

Another object of the present invention is to provide a serial printer in which the driving force of a common drive source can be utilized for the up-down motion of the recording head and for the reciprocating motion of the carrier supporting the recording head.

Still another object of the present invention is to provide a serial printer in which the driving force of a single motor is utilized for the up-down motion of the recording head and for the reciprocating motion of the carrier. The up-down motions of the recording head can still be appropriately achieved during the forward motion of the carrier.

DETAILED DESCRIPTION OF THE PREFERRED EMBODIMENTS

Now the present invention will be discussed in detail by embodiments thereof shown in the attached drawings.

The following embodiment is a thermal transfer printer with a movable carrier, in which said carrier is self driven by a motor provided thereon and driving a carrier pinion gear which meshes with a rack fixed to the body of the printer, and the carrier is disconnected from said rack at the left-end position but is linked with a sheet feeding mechanism to effect sheet feeding, thereby reducing the motor load.

Although the following embodiment is realized with a thermal transfer printer, the present invention is applicable also to other serial printers such as an ink jet printer or a mechanical impact printer.

Figures 1A, 1B:
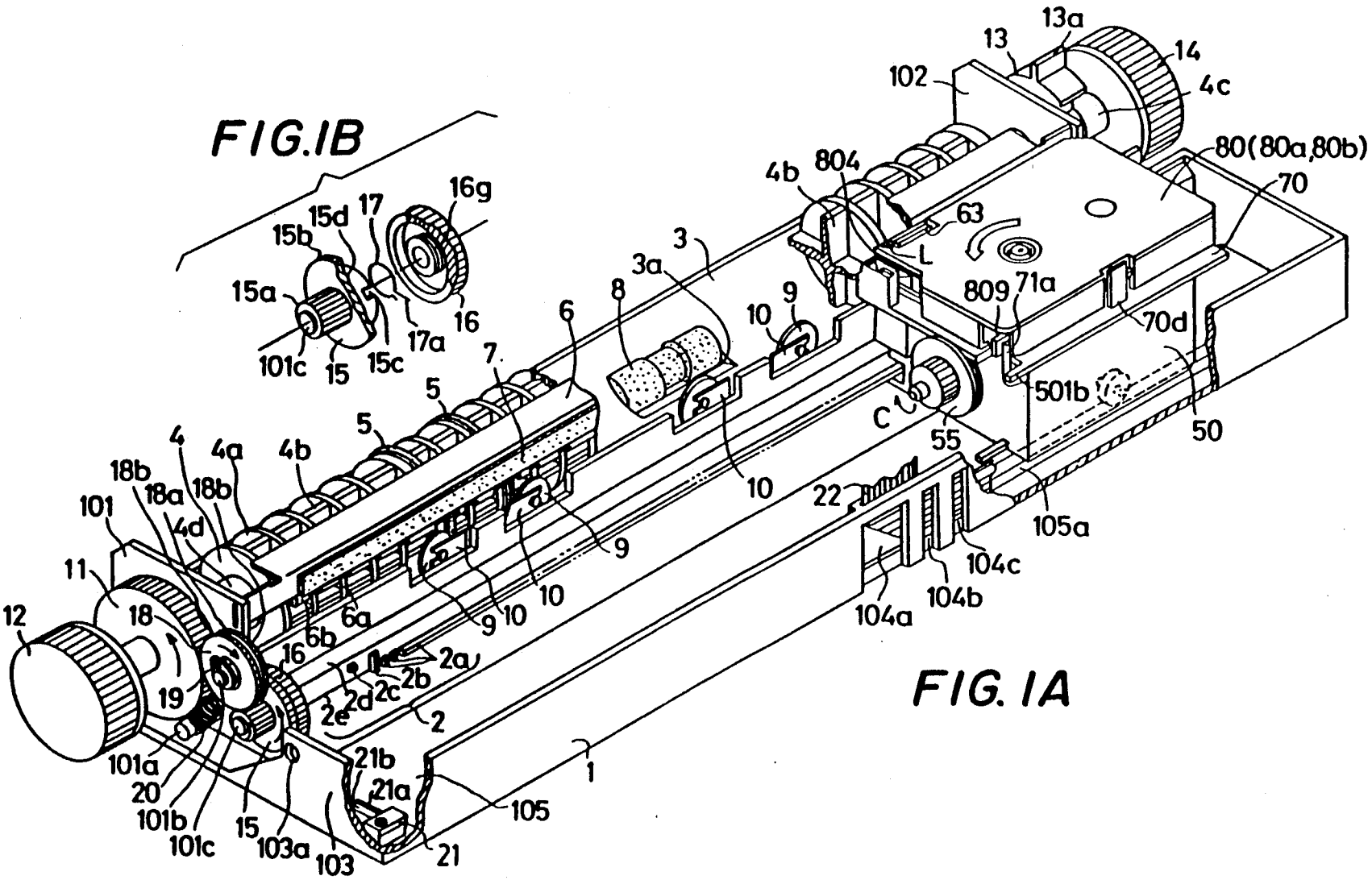
FIGS. 1A and 1B are perspective view of an embodiment of the present invention.
Figure 2:
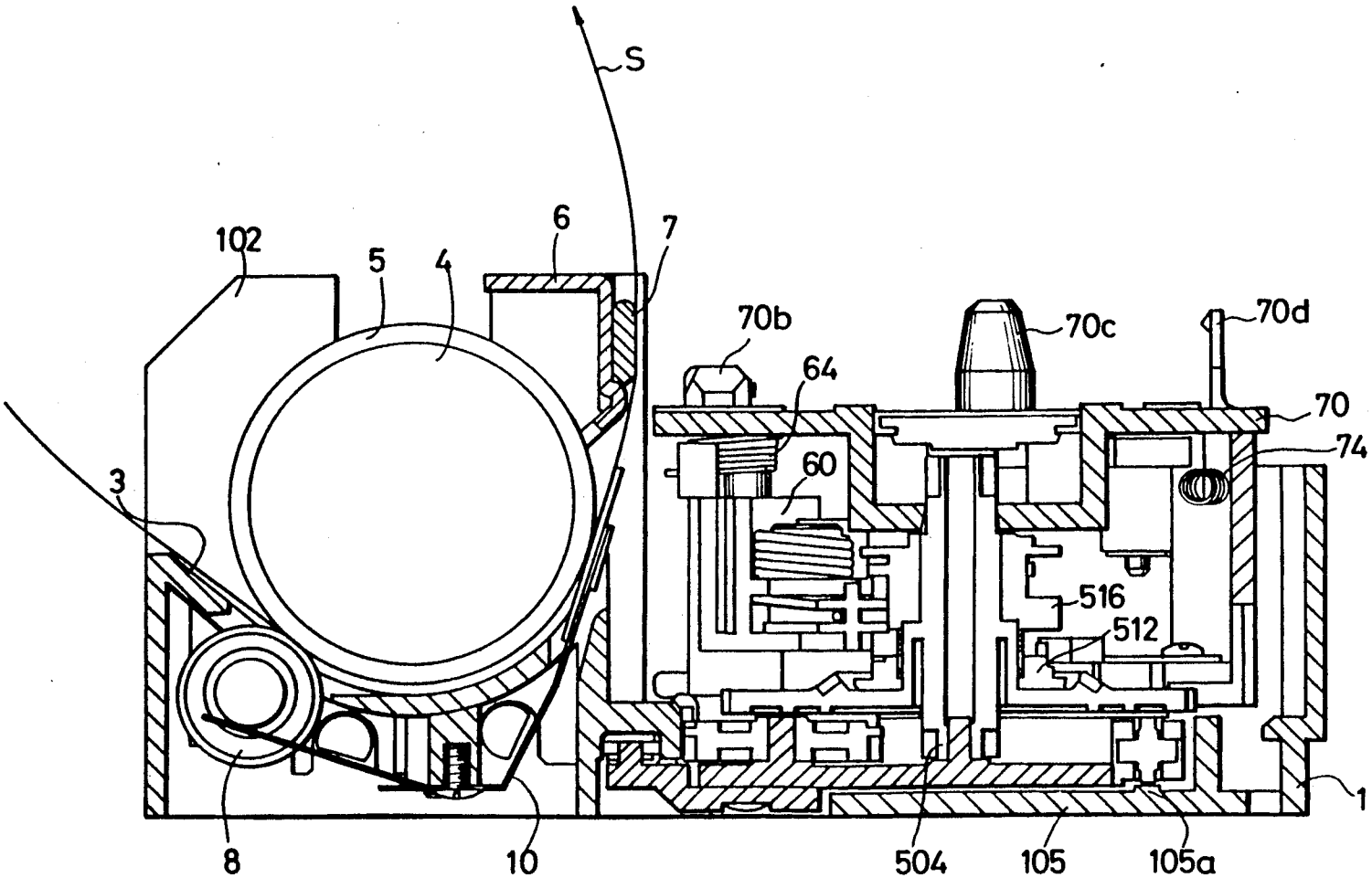
FIG. 2 is a cross-sectional view of an embodiment of the present invention.
Figure 3:
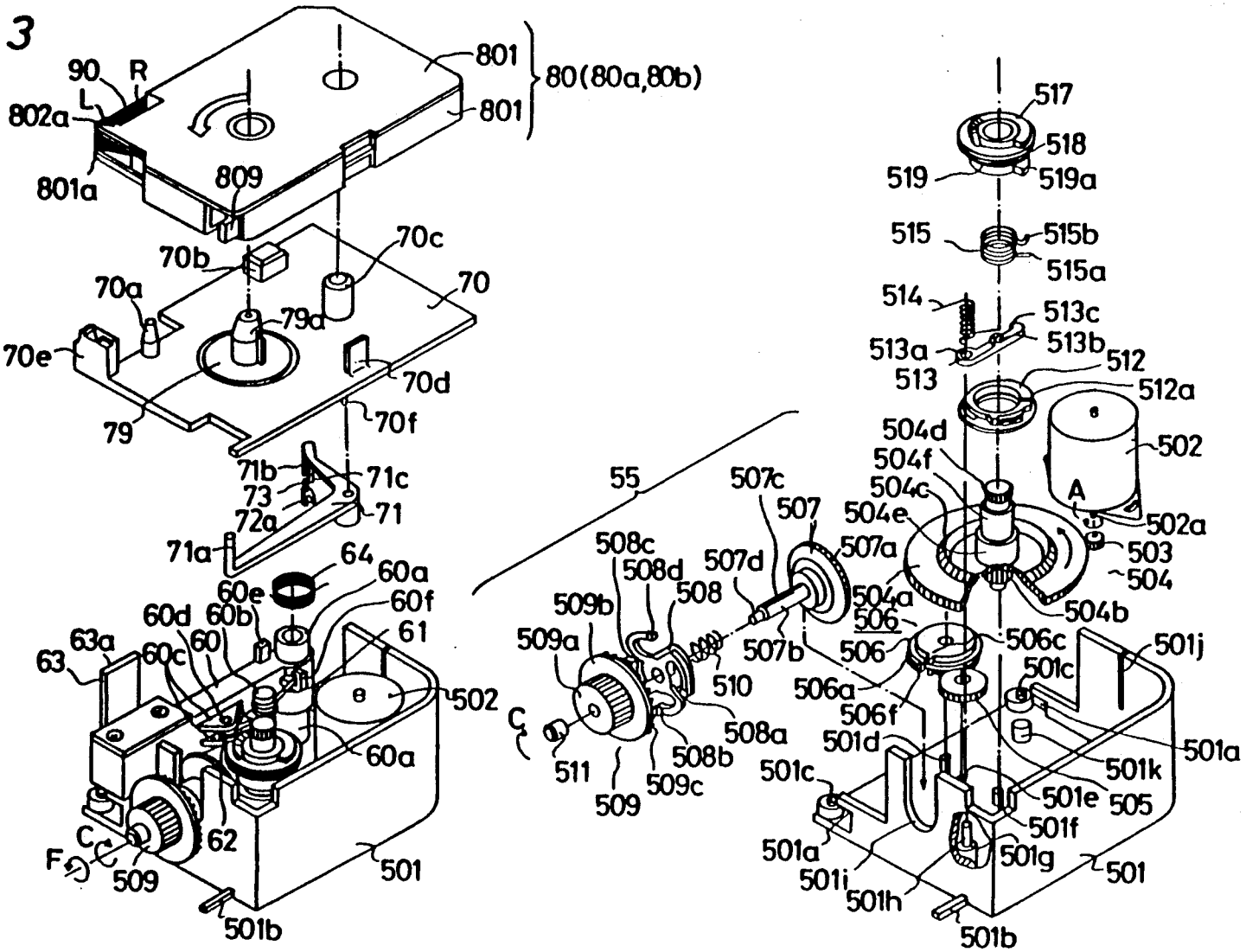
FIG. 3 is an exploded perspective view of a carrier thereof.

FIGS. 1A and 1B are perspective views of an embodiment of the present invention. As will be explained in the following, the printer of the present embodiment can be loaded with a cassette for so-called self-correction ink ribbon, a two-color ink ribbon cassette or an ordinary single-color ink ribbon cassette to achieve single-color recording, multi-color recording or correction or erasure of such recording, fully exploiting the characteristics of the load ribbon. In FIGS. 1A and 1B, a base member 1 is provided with a left side plate 101, a right side plate 102, and a gear support plate 103. Said left side plate 101 is provided with shafts **101*a*, 101*b*, 101*c* for supporting springs and gears to be explained later. Also the gear support plate 103 is provided with a guide hole 103*a* for supporting the shaft of a bevel gear to be explained later. In the front part of the base member 1 there are provided grooves 104*a*, 104*b*, 104*c* for accomodating flexible cables. On the bottom plate 105 of the base member there is provided a guide rail 105***a* over the entire width of said bottom plate. A rack 2 is provided in a predetermined position of the base member 1 along the direction of recording, and meshes with a pinion gear of the carrier to be explained later, in the course of printing operation. Said rack is provided with plural rack teeth 2*a*, arranged at a predetermined pitch and occupying a part of the thickness of said rack 2. At the left end of said rack teeth 2*a* there is provided a stop tooth 2*b* over the entire vertical thickness of the rack 2. Also at a position of two tooth pitches from said stop tooth and above the teeth 2*a*, there is provided a start tooth 2*c* of a predetermined length. Said rack 2 is further provided with an upper guide face 2*d* and a lower guide face 2*e* in order to guide the carrier to be explained later. A paper pan 3, integrally formed with said base member 1 is provided with two square holes 3*a* (one being not shown) for accepting pinch rollers to be explained later.

A paper feed roller, composed of alternately positioned disk-shaped paper guides 4*a* and cross-shaped plates 4*b*, is integrally molded with a plastic material such as polycarbonate or ABS resin. On both ends of said paper feed roller 4 there are similarly integrally formed guide shafts 4*c*, 4*d*, which are rotatably supported by the left side plate 101 and the right side plate 102. Paper feed rubber rollers 5, having rubber-made periphery, are provided at predetermined positions spaced from the paper feed roller 4. In the present embodiment there are employed four paper feed rubber rollers 5 (two not being shown).

Thus, in the present embodiment, the guide shafts 4*c*, 4*d*, disk-shaped guide plates 4*a* and paper feed rubber rollers 5 are integrally formed, and the paper feed rollers 5 are covered with rubber on the peripheries thereof to securely transport a recording sheet S with high friction, while the guide plates 4 guide the sheet S with low friction. Though the guide plates 4*a* have a slightly smaller diameter than that of the rubber rollers 5, they may also be of the same diameter.

Figure 21:
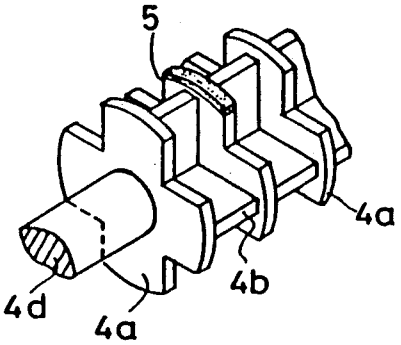
FIG. 21 is a partial perspective view of another embodiment of the sheet feeding mechanism.

A platen holder 6 is supported between the left and right side plates 101, 102, and is provided with grooves 6*a* in positions corresponding to said guide plates 4*a*of the paper feed roller 4 and said paper feed rubber rollers 5. In order to guide the leading end of the transported sheet S, the platen holder 6 is provided with bent portions 6*b* at the lower end thereof, corresponding to the gaps in the paper feed roller 4 and the paper feed rubber rollers 5. More specifically, said bend ends 4*b*of the holder 6 enter the interior of the peripheries of said rollers 4, 5 (in the cross section) in the gaps of said rollers, thereby preventing undesired entry of the sheet into said gaps. The guide plates 4*a*and the rubber rollers 5 need not necessarily be disk-shaped but can be of other forms having arc portions as shown in FIG. 21.

On the front face of the platen holder 6, facing the printing head to be explained later, there is adhered, along the printing direction, a platen 7 composed of an elastic and heat-insulating sheet such as foamed polyurethane sheet, in order to support the recording sheet at a predetermined position in the recording operation by the printing head. Pinch rollers 8, maintained in pressure contact with the paper feed rubber rollers 5, are lined with rubber for fetching the leading end of the sheet at the insertion thereof (one of the pinch rollers not illustrated). Pinch disks 9, composed of thin disk-shaped plates, are rotatably supported and are so positioned as to engage, in the vicinity of the external peripheries thereof, respectively with the paper feed rubber rollers 5. Said pinch disks 9 are biased by pinch springs 10 and rotate with said rubber rollers 5 in the absence of the recording sheet, for example before the insertion thereof, thereby dissipating the bias pressure. Said pinch springs 10 also press the central parts of said pinch rollers 8.

Figure 10:
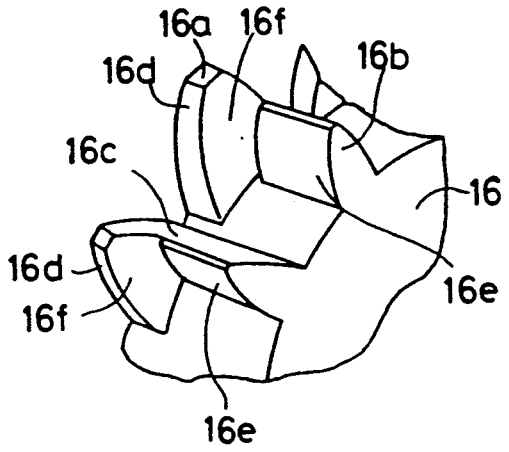
FIG. 10 is a perspective view of a shutter gear constituting an embodiment of the present invention.
Figure 22B:
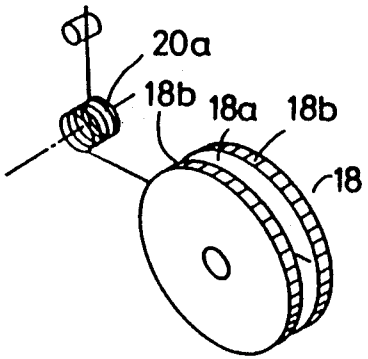
FIGS. 22A, 22B and 22C are schematic perspective views of an embodiment for preventing backlash.
Figure 22C:
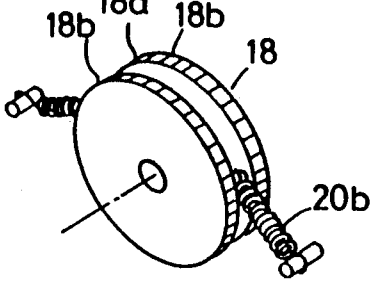
Figure 22A:
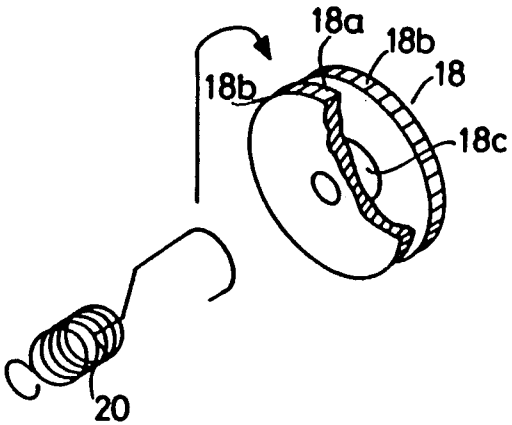

A paper feed roller gear 11 is mounted on the rotary shaft 4*d* of the paper feed roller 4, and rotates integrally therewith. A left-end platen knob 12 is integrally mounted to said paper feed roller 4 and rotates said roller 4 when said knob 12 is manually rotated. A release lever 13, rotatably fitted on the shaft 4*c* of the paper feed roller 4 and also rotatably fitted on the right side plate 102 actuates a paper release mechanism to be explained later when a knob 13*a* is maniplated, thereby separating the aforementioned pinch rollers 5 and pinch disks 9 and freeing the printing sheet. A right-end platen knob 14 is integrally mounted on said paper feed roller 4. A paper feed gear 15 and a shutter gear 16 are supported rotatably on the shaft 101*c* of said left side plate 101. As shown in FIG. 1B, said paper feed gear 15 is constructed as a stepped structure composed of a smaller gear 15*a* and a larger gear 15*b*, and is further provided with a cylindrical portion 15*d* having a partial notch 15*c*, in a position corresponding to said shutter 16. The shutter gear 16 is provided, as shown in a magnified view in FIG. 10, with feeding teeth 16*a* of normal form and shutter teeth 16*b* with a partially cut-off form, wherein a tooth face 16*c* is common to both teeth while the other tooth face is formed as two levels 16*d* and 16*e*, with an abutting face 16*f* therebetween. On a cylindrical portion 16*g* of the shutter gear 16 there is wound a friction spring 17 with a predetermined force, of which an end 17*a* engages with a notch 15*c* of said paper feed gear 15. Said notch 15*c*has an angle corresponding to 1.5 teeth of the larger gear 15*b*, and the end 17*a* of the friction spring 7 is rendered freely movable in said notch 15*c*, so that the paper feed gear 15 and the shutter gear 16 are rendered mutually rotatable within the angle of said notch 15*c*but move together beyond said angle under the braking action of said friction spring 17. A pressure gear 18 has a central, groove 18*a*, with two rows of gear teeth 18*b* of the same phase on both sides of said groove 18*a*. The internal diameter of said pressure gear 18 is made considerably larger than the supporting shaft 101*b*, so that the center of the pressure gear 18 is not defined by said shaft 101*b*. A grip ring 19 is mounted on a predetermined position of the shaft 101*b*, thus limiting the movement of said pressure ring in the axial direction and maintaining said gear on the shaft 101*b*. A pressure spring 20 is provided between a cylindrical portion 18*c* at the bottom of the groove 18*a* of the pressure gear 18 and the shaft 101*a*, thus pulling said pressure gear 18 so as to maintain said gear in contact with the paper feed roller gear 11 and the smaller gear 15*a* of said paper feed gear 15. In this manner the backlash among the paper feed gear, pressure gear 18 and paper feed roller gear 11 can be eliminated (see, for example, FIG. 22A). The removal of backlash can also be achieved by applying a torsion spring 20*a* or a tension spring 20*b* in the groove 18*a* as shown in FIGS. 22B and 22C.

A switch 21, with contacts 21*a*, 21*b* is mounted in a predetermined position of the base member 1. A carrier 50 is provided slidable in the printing direction, being guided by the rack 2 and the guide rail 105*a* of the base member 1. A ribbon cassette 60 is loaded on said carrier 50.

Now reference is made to FIGS. 2 to 5B for explaining the internal structure of the carrier 50.

In these drawings a carrier base 501 is provided with a pair of guide portions 501*a* for guiding the aforementioned rack 2, on both sides. A projection 501*b* for turning on said switch 21 is provided at a predetermined position. Furthermore there are integrally formed shafts 501*c*, 501*d*, 501*e*, 501*f* for supporting rack rollers and gears to be explained later and a shaft 501*h* with a shoulder 501*g* for supporting a control lever to be explained later. There are furthermore provided a groove 501*i* for supporting a bevel gear and a groove 501*j* for supporting a flexible cable. A stepping motor 502 with a shaft 502*a* having a motor pinion gear 503 is mounted on said carrier base 501.

A center gear 504 is composed of an integral structure of a large gear 504*a* meshing with said motor pinion 503, a small gear 504*b* provided thereunder, a bevel gear 504*c* and a ribbon driving gear 504*d* positioned at the top. Also provided are a spring clutch boss 504*e* and a head cam boss 504*f*. The center gear 504 is supported, at a bottom hole, by the shaft 501*f* of the carrier base 501, and is also rotatably supported at the base portion of the ribbon driving gear 504*d* by a hole provided in a carrier cover to be explained later. An idler gear 505 is rotatably supported by the shaft 501*e* and meshes with the small gear 504*b* of the center gear 504. A carrier pinion gear 506 with pinion teeth 506*a* is located along the entire periphery in the lower part, with a single synchronization tooth 506*c* at the upper part and a guide ring 506*e* at the center. The guide ring 506*e* is provided with a notch 506*f* corresponding to the synchronization tooth 506*c*, but is otherwise equal to or slightly larger than the outer diameter of said pinion teeth 506*a*. In the vertical direction, the pinion teeth 506*a* are so positioned as to mesh with the rack teeth 2*a*, while the synchronization teeth 506*b*, 506*c*, 506*d* are so positioned as to engage with the aforementioned start tooth 2*c*. The guide ring 506*e* is so positioned as not to engage with the rack teeth 2*a* nor with the start tooth 2*c*, and is so assembled that the notch 506*f* is synchronized with the stop tooth 2*b*. The carrier pinion 506*a* is rotatably supported on the shaft 501*d* of the carrier base 501.

In the following there will be explained a bevel gear unit 55. A bevel gear member 507 is provided with a bevel gear 507*a* meshing with the bevel gear 504*c* of the above-mentioned center gear 504, a bevel gear shaft 507*b* having a key groove 507*c*, and an end shaft portion 507*d* for fitting a stop ring as will be explained later. A ratchet plate 508 having four arms with respective claws 508*a* is made of an elastic plastic plate such as polyacetal resin plate, and is provided internally with an unrepresented projection engaging with the key groove 507*c* of said bevel gear 507*b*, thus being axially slidably mounted on said bevel gear shaft 507*b*. A ratchet gear 509 is composed of a gear portion 509*a* and a ratchet portion 509*b*, having plural ratchet teeth 509*c* in a circular pattern on a face thereof. A compression ratchet spring 510 is provided for biasing said ratchet plate 508 and ratchet gear 509. A stop ring 511 is fitted on the end shaft portion 507*d* of said bevel gear shaft 507*b* for maintaining the ratchet plate 508 and ratchet gear 509 in place against the pressure of the ratchet spring 510. Said stop ring 511 is so designed to fit in the guide hole 103*a* of said base member 1, with a suitable clearance. The rotary force of said center gear 504 is transmitted from the bevel gear 504*c* to the bevel gear 507*a* of the bevel gear member 507, then to the ratchet plate 508 through the key groove 507*c*, and to the ratchet gear 509 through the meshing of the claws 508*a* and the ratchet teeth 509*c*. Said claws 508*a* and ratchet teeth 509 are sawtooth-shaped to transmit the rotary force in one direction, but the rotation is not transmitted in the opposite direction by the elasticity of the arms of the ratchet plate 508 and by the presence of the ratchet spring 510. A control cam 512 is provided with a groove 512*a* for engaging with an end of a clutch spring to be explained later, and is provided with two engaging portions, at predetermined angular positions A, B, each having an engaging face 512*b* for engaging with a control lever, a trigger face 512*c* and an inclined face 512*d* (see, for example, FIG. 5A). Said control cam 512 is rotatably fitted on the spring clutch boss 504*e* of said center gear 504. A control lever 513, having a rotary hole 513*a*, a spring support portion 513*b* and a claw 513*c*, and is rotatably fitted on the shaft 501*h* of the carrier base 501. A control lever spring 514, composed of a compression torsion spring, biases said control lever 513 toward the control cam 512 and toward the shoulder 510*g* of the carrier base. A clutch spring 515 is inserted, at an end 515*a* thereof in the groove 512*a* of said control cam 512, and engages at the other end 515*b* with a pin of a head cam to be explained later. The clutch spring 515 is fitted on the spring clutch boss 504*c* of the center gear 504. A head cam 516 is provided, at the uppermost part thereof, with a switching cam 517 for actuating a switch lever to be explained later. Said switching cam 517 is composed of an inclined cam 517*a*, a switch groove 517*b* and a cam face 517*c*. Under said switching cam 517 there is provided a ribbon feeding cam 518 provided partially with a notched cam 518*a* and a stop cam 518*c*. Thereunder provided is a printing cam 519 of which a pressing portion with a larger radius presses a head roller to be explained later, thereby biasing the printing head toward the platen. The head cam 516 is rotatably fitted on the head cam boss 504*f* of the center gear 504 (for details see FIG. 5B).

A head holder 60 has a vertical rotary shaft 60*a*, rotatably supported by the shaft 501*k* of the carrier base 501 and by a shaft (now shown) of a carrier cover 70 to be explained later. There are also shown a spring shaft 60*b*; a cam roller holder 60*c* consisting of upper and lower holding plates, having elongated holes 60*d* in the vertical direction for guiding a cam roller to be explained later; spring holder pins 60*e*, 60*f*; and a head spring 61 of which coil portion is supported by said spring shaft 60*b*, and end portions thereof are respectively held by the spring holder pin 60*f* and the groove of a cam roller 62. The cam roller 62 is provided with an external periphery portion 62*a*, guide shafts 62*b*, 62*c* extended upwards and downwards to be inserted in the hole 60*d* of said head holder 60, and a groove 62*d* for receiving an end of said head spring 61. The cam roller 62 is pressed by the head cam 516, whereby a printing head 63, to be explained later, is pressed to the platen 7 by the resilient force of the head spring 61. The printing head is mounted on said head holder 60. A flexible cable from the printing head 63 is guided in the carrier 50, connected with the terminals of the aforementioned stepping motor 502, and is further guided out of the carrier 50 through a groove 501*j* of the carrier guide 501, but is omitted in the drawing for the purpose of simplicity.

A head return spring 64 has a coil portion supported by the rotary shaft 60*a* of the head holder 60, and end portions respectively supported by the spring holder pin 60*e*and the carrier base 501.

A carrier cover 70, constituting a cassette loading portion for detachably loading a ribbon cassette 80, is provided with guide pins 70*a*, 70*b*, 70*c* for guiding the ribbon cassette 80, and a finger 70*d* for pressing the ribbon cassette 80 against the guide pins and maintaining said cassette in place There are also provided an index 70*e* and a shaft for supporting a switch lever to be explained later. In the present embodiment, the cassette loading portion 70 can accept a self-correction ink ribbon cassette 80*a*, a two-color ink ribbon cassette 80*b* or an ordinary monocolor ink ribbon cassette 80*c*.

A switch lever 71, rotatably supported by said shaft 70*f*, is provided with a pressing pin 71*a*at an end, and, at the other end, with a slide shaft 71*b* and a rotation limiting pin 71*c*.

Figure 4:
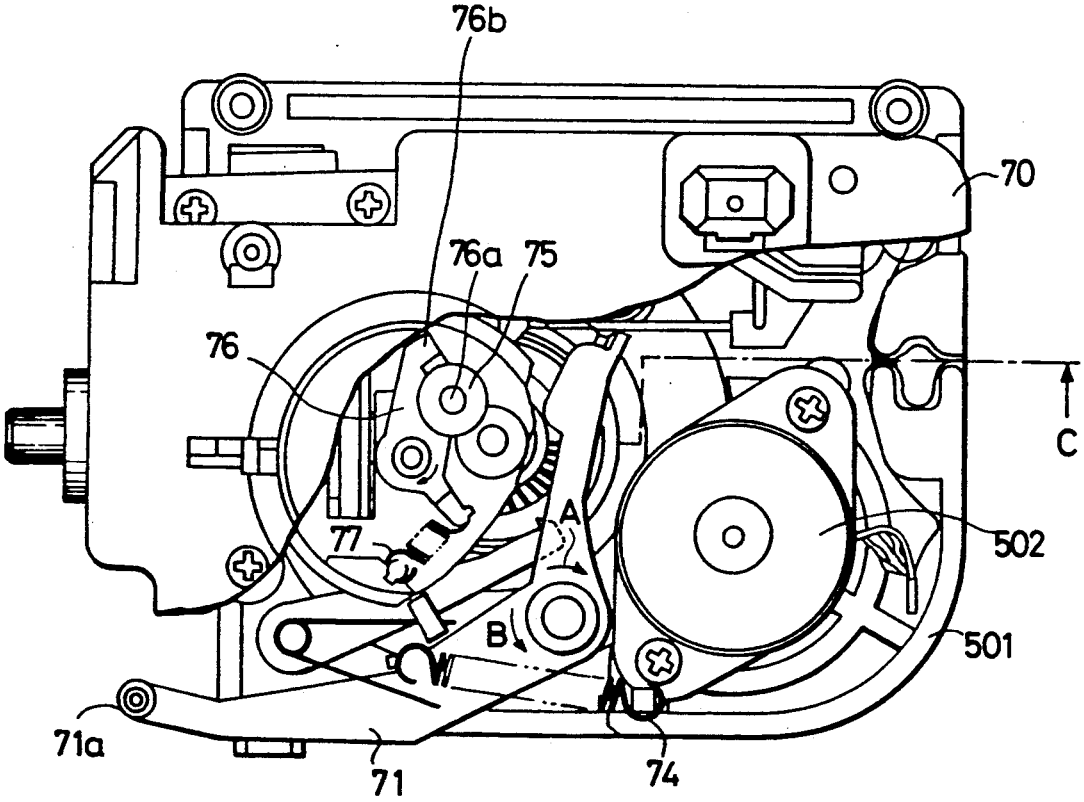
FIG. 4 is a cross-sectional view of the carrier.
Figure 5A:
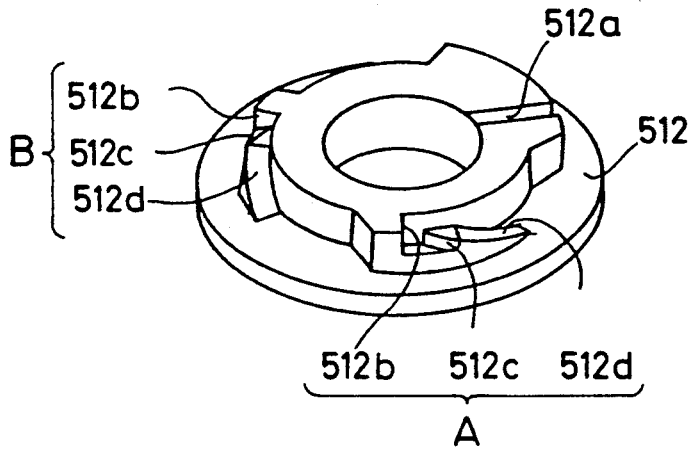
FIGS. 5A and 5B are enlarged perspective views of a control plate and a head cam.
Figure 5B:
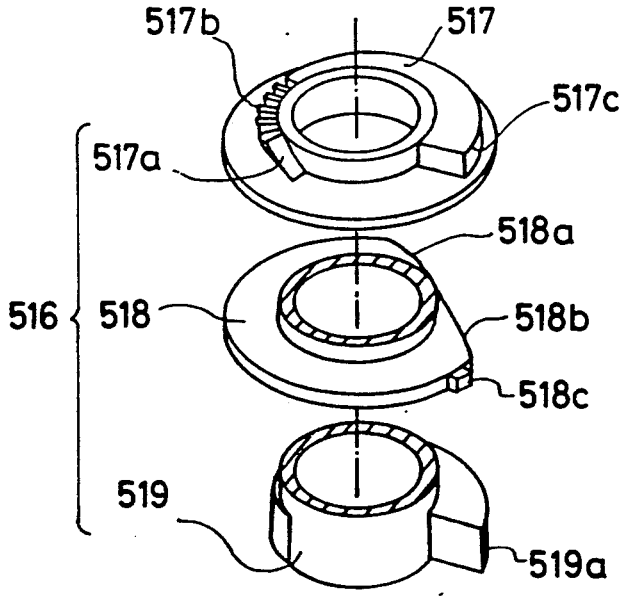
Figure 6:
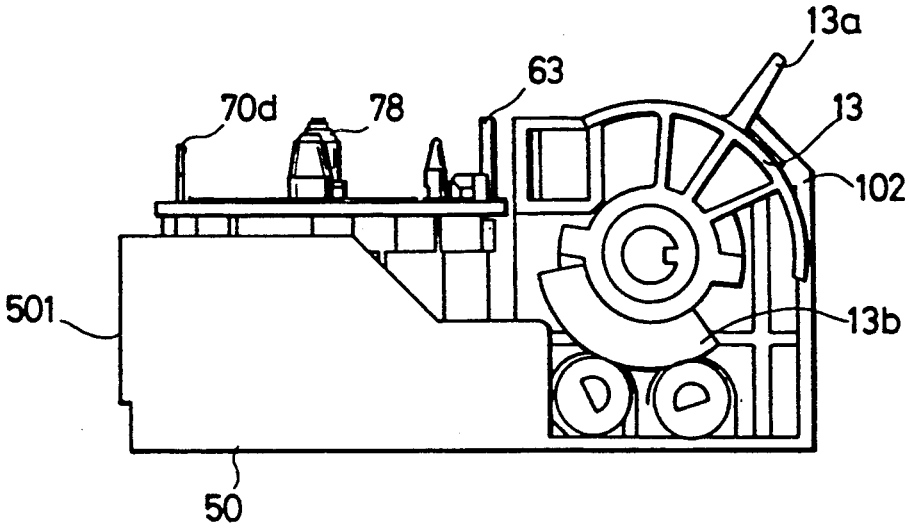
FIGS. 6 and 7 are right- and left-hand lateral views of an embodiment of the present invention.
Figure 7:
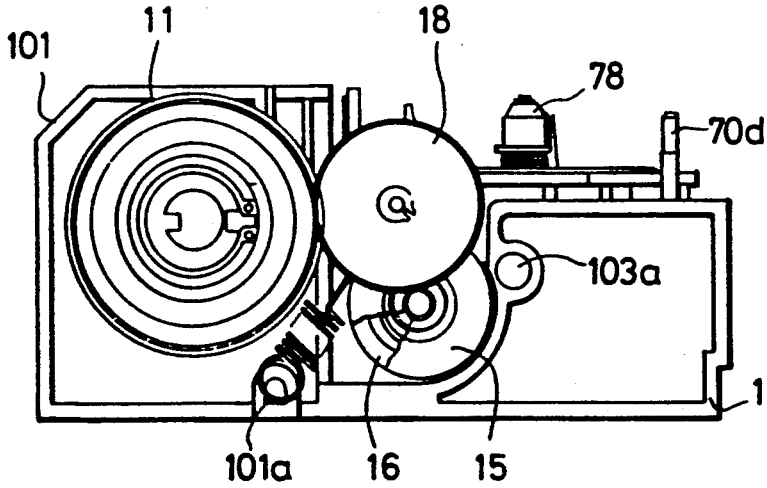

A switching slider 72 is slidably supported by the slide shaft 71*b* of said switch lever 71, but is limited in rotation by the engagement of a U-shaped groove 72*a* with said rotation limiting pin 71*c*. The switching slider 72 is constantly biased downwards by a switching slider spring 73. A switch lever spring 74 is provided between the switch lever 71 and the carrier cover 70 as shown in FIG. 4 to constantly bias the switch lever 71 counterclockwise, as indicated by an arrow B. In FIG. 4, a ribbon idler gear 75 meshes with a ribbon driving gear 504*d* of said center gear 504 and is supported by the shaft of a ribbon lever to be explained later, so that it can be disengaged from said ribbon driving gear by the rotation of the ribbon lever. A ribbon lever 76 rotatably supported by the carrier cover 70 is provided with a shaft 76*a* supporting said ribbon idler gear 75, and an approximately square U-shaped ribbon lever arm 76*b* maintained in contact with the external periphery of a ribbon feed cam 518 of said head cam 516. A ribbon lever spring 77 biases said ribbon lever 76 clockwise.

A friction clutch shaft 78 is pressed into the carrier cover 70. A friction clutch 79 (shown in FIG. 3) meshes, by a represented lower gear portion thereof, with the ribbon idler gear 75, thereby transmitting the driving power to a winding spool 79*a* with a predetermined friction. Since the center of rotation of said ribbon lever 76 coincides with that of the friction clutch 79, it remains meshed with the gear regardless of the rotation of the ribbon idler gear 75.

Figure 8:
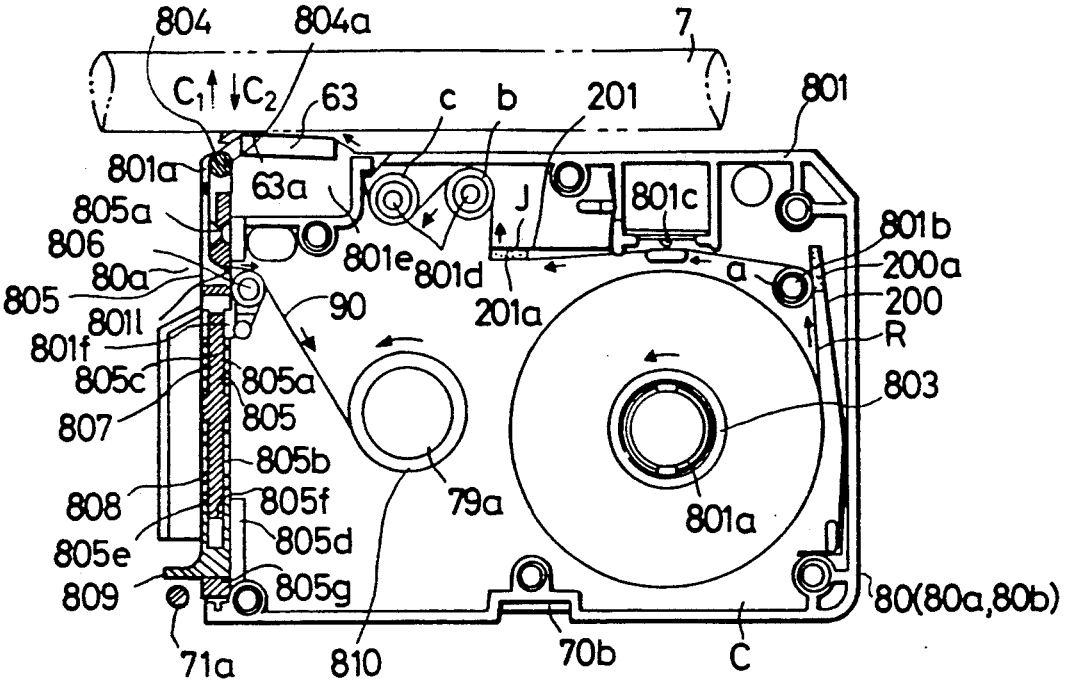
FIGS. 8 and 9 are plan views of the interior of a ribbon cassette constituting an embodiment of the present invention.
Figure 9:
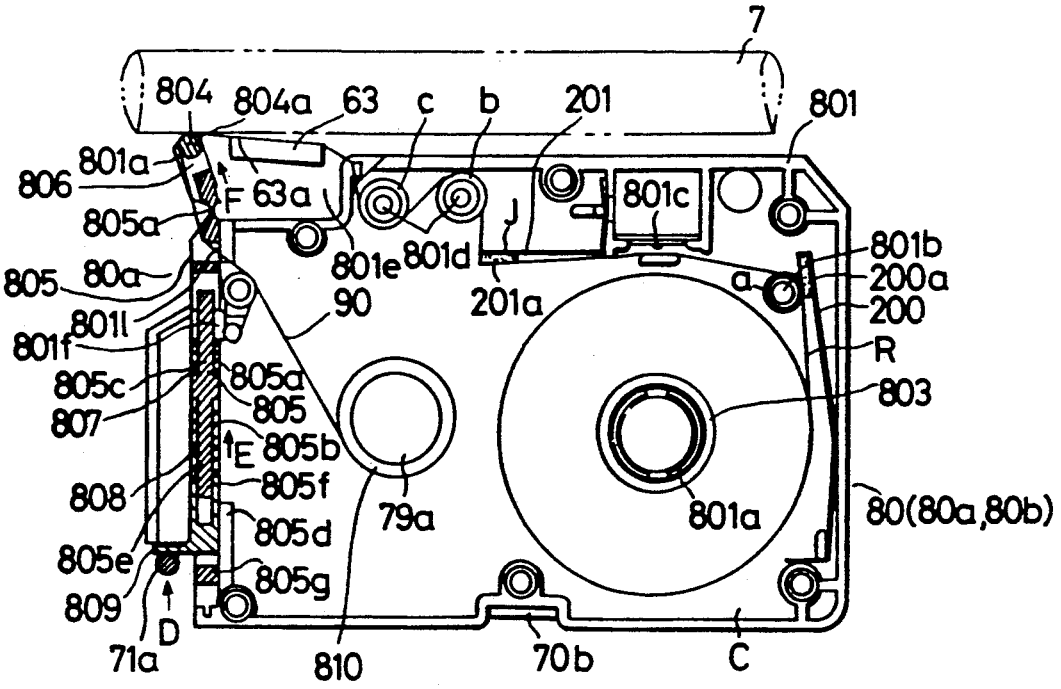

A ribbon cassette 80 has a lower part 801 and a cover part 802. The internal structure of the ribbon cassette 80 is shown in FIGS. 8 and 9. An ink ribbon R is unwound from a ribbon roll 803 as indicated by arrows, passes in front of the printing head 63, further guided through a delay roller 804, a delay lever 805 and a guide roller 806, and is wound on a winding core 810. Said winding core 810 engages with the winding spool 79*a* on the carrier 50, thus receiving the rotating force of said spool. The delay lever 805 is composed of a material having a bend resistance such as polypropylene, and is provided with a bent portion 805*a* which is made very thin so as to be bent with a small force. A delay lever return spring 807 constantly maintains the delay lever 805 in a retracted state. A delay spring 808, positioned between a slider 809 and the delay lever 805, pushes the delay lever 805 toward the platen when the slider 809 is pushed, whereby the delay roller 804 is pressed against the platen 7. In a portion of the delay lever 805 in front of the bent portion 805*a* there is provided an unrepresented pin to be guided by an inclined slit L provided in the lower part 801 and the cover part 802 of the ribbon cassette. Therefore, when pressed to said platen 7, the delay roller 804 advances diagonally along the slit L and touches the platen at a position distant from the printing head 63 (see FIG. 9). Said ribbon cassette may have different forms according to the ink ribbon contained therein, or may have the same form if the space of the ink ribbon is suitably marked. In short, the ribbon cassette may have an arbitrary form as long as it can be guided by the guide pins 70*a*, 70*b*, 70*c* and can be fixed to the carrier cover 70 by the finger 70*d*.

Figure 13:
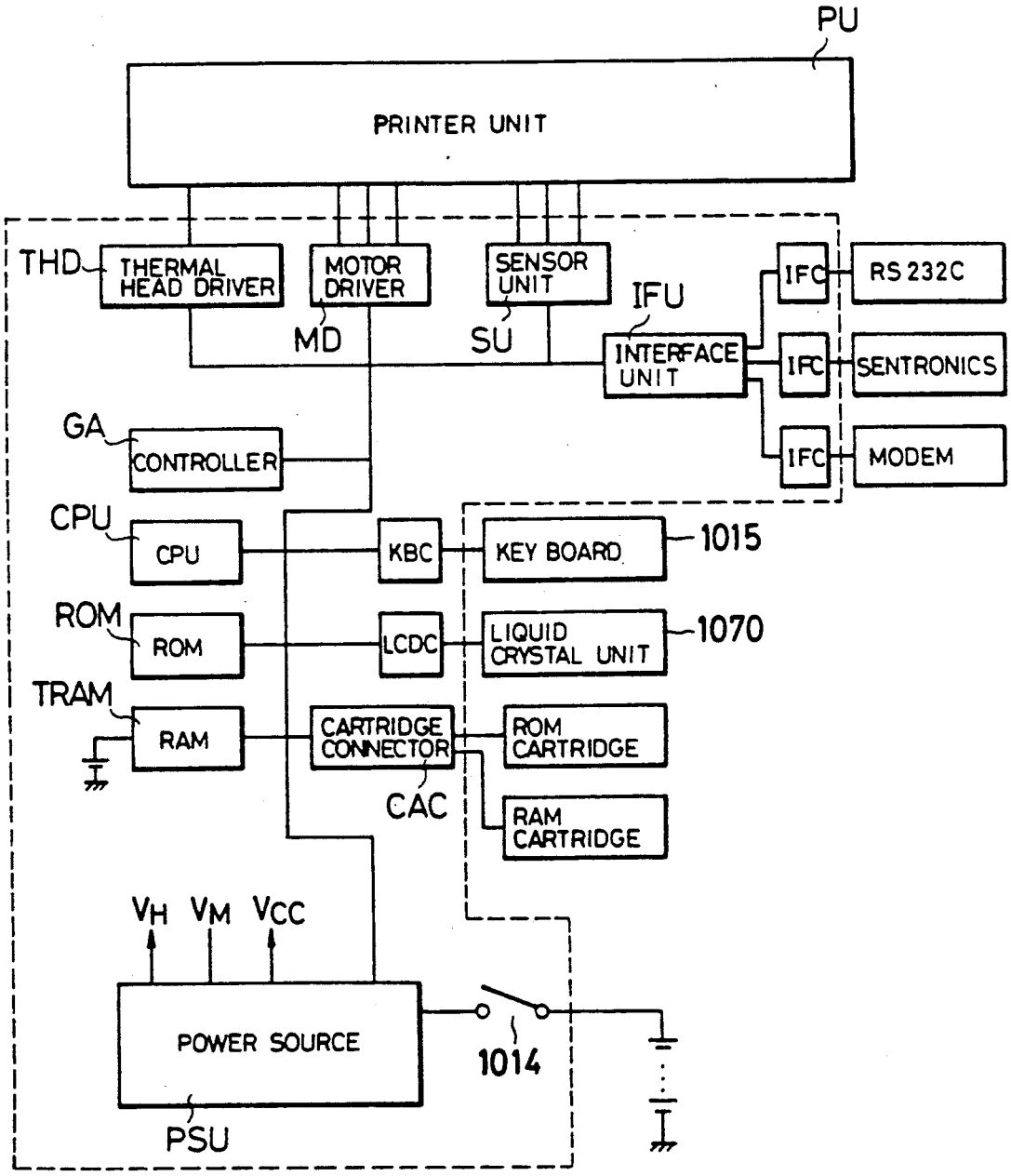
FIG. 13 is a block diagram of an output unit of an electronic typewriter employing the printer of the present invention.

FIG. 13 is a block diagram of an output unit in the case when the printer of the present embodiment is employed in an electronic typewriter, and the function of said printer is controlled by said output unit. The aforementioned motor 502 and thermal printing head 63 are connected through a flexible cable 22 to a thermal head driver THD and a motor driver MD. Also the switch 21 is connected to a sensor unit SU.

In FIG. 13 there are provided a power switch 1014, a keyboard 1015, and a liquid crystal display unit 1070. In the present embodiment said keyboard 1015 is provided with a correction button (not shown) and a color selection button (not shown). Thus, when a self correction ribbon cassette (capable of printing and correction with the same ribbon) is loaded on the carrier 50, the actuation of the correction ribbon causes the delay roller 804 to protrude, thereby correcting the recording by lift-off or cover-up process. Also when there is employed an ink ribbon cassette utilizing an ink ribbon capable of printing plural colors, as proposed by the present applicant in Japanese Patent Application Nos. 260403/1984 and 298831/1985, the actuation of the color selection button causes the delay roller 804 to protrude or retract, thereby printing another color, for example blue, different from the basic color, for example black.

In the following there will be given further explanation of FIG. 13.

It is to be noted that FIG. 13 only shows the principal connections of different circuit blocks and the detailed control lines are omitted for simplicity. The broken-lined area indicates a central processing unit CPU.

The central processing unit CPU reads various programs and data from ROM etc. and executes various processings, judgements and controls. There may be employed plural CPU's if necessary. A read-only memory ROM stores various programs for the CPU, character codes and dot patterns (character generator) and other data necessary for printing. A read-write memory TRAM is provided with a working area for temporarily storing the data under processing and the results of processing; a buffer area for storing data entered from the keyboard 1015 and an external interface IFU to be explained later; a text area for storing texts etc., and is backed up by a battery for storing data even when the power supply is cut off.

The CPU is also connected to the printer unit PU through the thermal head driver THD, motor driver MD and sensor unit SU.

The thermal head driver THD drives the thermal printing head 63 in said printer unit PU under the control of the CPU, and the motor driver MD drives the motor 502 under the control of the CPU.

The sensor unit SU transmits the information from an unrepresented limit sensor in the printer unit PU to the CPU.

A power supply unit PSU supplies power VH for heating the thermal printing head 63, power VM for driving the motor 502 and power Vcc for other logic circuits.

A controller GA executes various controls under the control of the CPU, for example varying the voltage and current of the power supply VH for said thermal printing head 63, and regulating the heating time and duty ratio of the thermal printing head 63.

The CPU is also connected to a keyboard 1015, through a keyboard connector KBC, for entering various data necessary for printing and editing.

The CPU is further connected to a liquid crystal display unit 1070, through LCD connector LCDC, for displaying data entered from the keyboard 1015 and other information.

Said liquid crystal display unit 1070 may be replaced by another display unit such as a cathode ray tube.

Furthermore the CPU can be connected, through an interface connector IFC, to an interface, such as RS232C, Centrointerface or modem, for control by an external control unit or for communication with external equipment.

Furthermore the CPU can be connected, through a cartridge connector CAC, to a ROM cartridge for special functions or for printing with a different font, or a RAM cartridge for expanding the data storage memory.

Furthermore there may be provided an acoustic output device such as a buzzer, though not illustrated in FIG. 13.

In the following there will be explained the function of the printer unit controlled by the above-explained output unit.

At first there will be explained up-down motion of the printing head. Rotation of the motor 502 in the normal direction by a signal from the CPU causes the motor pinion 503 to rotate in a direction A and the center gear 504, meshing with said motor pinion 503, in a direction B. In this state the clutch spring 515 wound on the spring clutch boss 504*e* of said center gear 504 rotates at the same time, and the control cam 512 rotates simultaneously as it is connected to an end 515*a* of the clutch spring 515. The claw 513*c* of the control lever 513 slides on the inclined face 512*d* of the control cam 512 and engages with the engaging face 512*b*, thus stopping the rotation of the control cam 512. In response the end 515*a* of the spring 515 is stopped to loosen said clutch spring 515, whereby said spring 515 no longer rotates integrally with the center gear 504 but is stopped.

In this state the center gear 504 continues to rotate. The control cam 512 engages with the control lever 513 at a position A shown in FIG. 11A, and the head cam 519 assumes a position shown in FIG. 11A wherein a pressing portion 519*a* presses the cam roller to press the printing head 63 against the platen.

In this state the ribbon arm 76*b* of the ribbon lever 76 is received by the notch (notched cam 518*a*, 518*b*) of the ribbon feed cam 518, and the ribbon idler gear 75 meshes with the ribbon driving gear 504*d* of the center gear 504. Consequently the rotation of said ribbon driving gear 504*d* is transmitted, through the ribbon idler gear 75, to the friction clutch 74.

Since the center gear 504 continues to rotate as explained above, the carrier 50 continues to move along the rack 2, by the power transmission through the smaller gear 504*b*, idler gear 505 and carrier pinion 506.

Figure 11A:
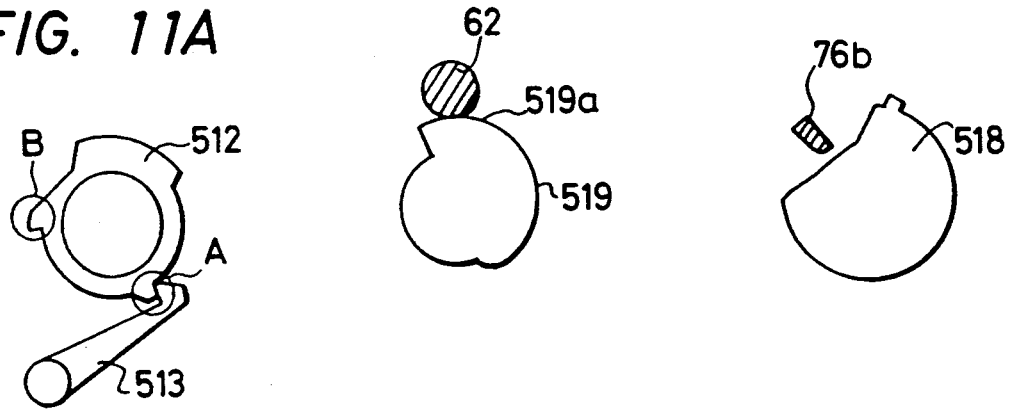
FIGS. 11A and 11B are schematic views showing the function of the control plate and the head cam.
Figure 11B:
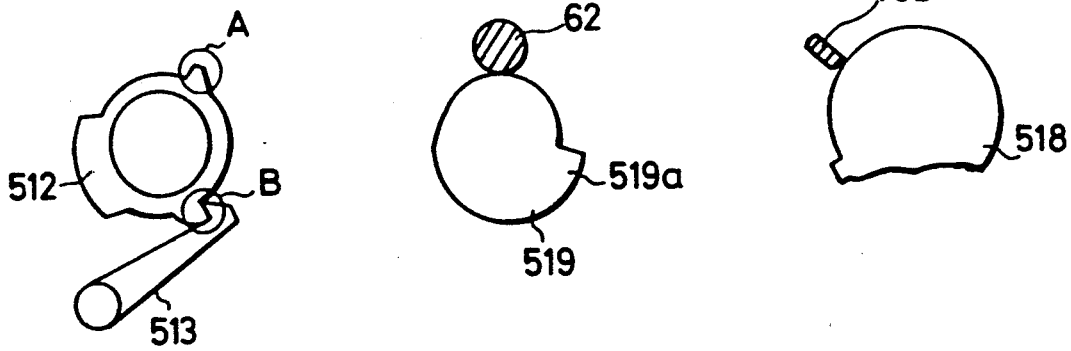

For a head-up motion (a rotation of the thermal printing head 63 in a direction away from the platen 7), the motor 502 is rotated inversely by a predetermined number of pulses in response to a signal from the CPU, whereby the center gear rotates in a direction opposite to B, and the control cam 512 rotates simultaneously by the loosening torque of the clutch spring 515. In this state the claw 513*c* of the control lever 513 is expelled to the outside by the trigger face 512*c* of the control cam 512. Then, when the motor 502 is again rotated in the forward direction after said inverse rotation by a predetermined number of pulses, the expelled control lever 513 cannot engage with the engaging face 512*b* of the position A, so that the control cam 512 can rotate in the forward direction to a next engaging position B. FIG. 11B shows this state, whereby the head cam 519 no longer presses the cam roller 62, so that the thermal printing head 63 is separated from the platen 7. Since the ribbon arm of the ribbon lever 76 is in contact with the external periphery of the ribbon feed cam 518, the ribbon idler gear 75 is separated from the ribbon driving gear 504*d*, so that the friction clutch does not rotate and the ribbon R is not advanced.

As explained in the foregoing, the inverse rotation of the motor 502 disengages the control lever 513 from the control cam 512, whereby the printing head 63 is shifted down toward the platen 7 and up away from the platen 7. In the present embodiment the gear train system has a backlash exceeding the amount of trigger rotation in order to prevent inverse motion of the carrier 50 at said trigger rotation, since a reverse motion of the carrier 50 by the trigger motion at the head-up motion will result in a slack or a smear in the ribbon R or an increase in the motor load. Also in the present embodiment, the carrier 50 is stopped once when the thermal printing head 63 is separated from the platen 7.

In the following there will be given an explanation on the function of the switch lever 71, while making reference to FIGS. 11A and 11B.

Figure 23A:
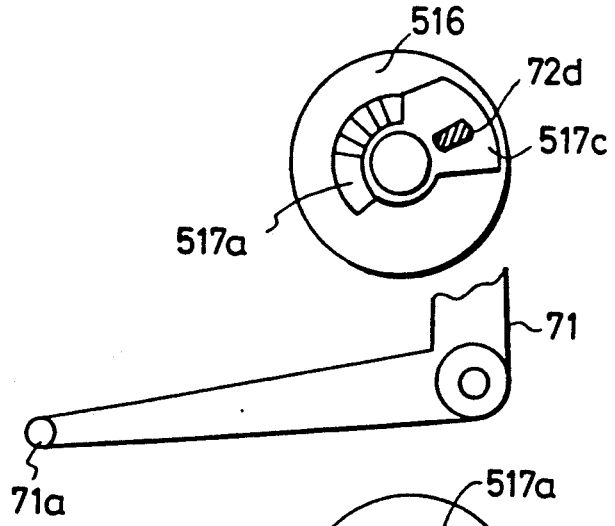
FIGS. 23A, 23B, 23C and 23D are schematic views showing the function of a switching lever.

In the normal head-down motion, as explained before, the control cam 512 rotates to the position A by a trigger action at the position B. In this state the switch lever 71 does not rotate since the head cam 516 stops when the switch slider 72, slidably connected to an end of the switch lever 71, passes through the inclined face 517*a* of the switch cam 517 positioned at the top of said head cam 516, further passes through the upper face of the switch groove 517*b* and becomes positioned on the cam face 517*c* (FIG. 23A).

Figure 23B:
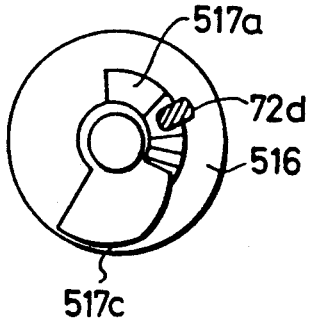
Figure 23C:
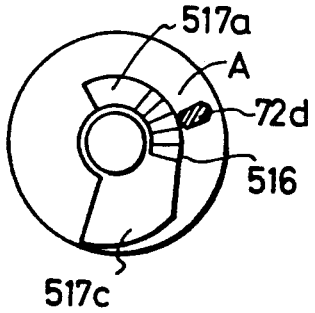
Figure 23D:
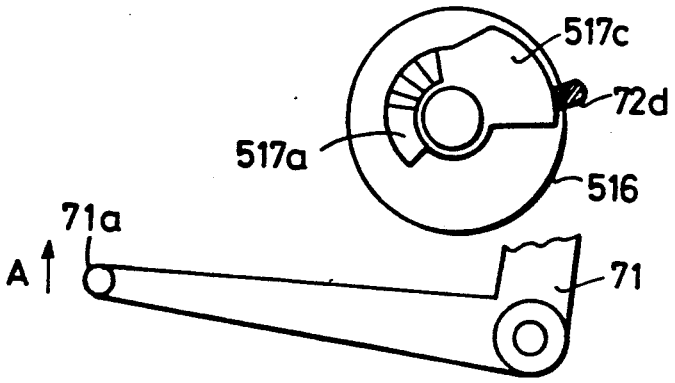

In order to rotate the switch lever 71, the motor 502 is inversely rotated (second trigger action) when the switch slider is positioned on the switch groove 517*b* of the aforementioned switch cam 517 as shown in FIG. 23B, whereby the switch lever 71 is expelled radially outwards as the switch groove 517*b* and the claw 72*d* of the switch slider 72 mutually engage. Consequently the switch lever 71 rotates in a direction A shown in FIG. 23C. In this state, the switch slider 72, being biased downwards by the switch lever spring 73, is maintained in contact with the cam face 517*c*. Thus the head-down motion is completed in the course of rotation of the switch cam when the switch slider 72 becomes positioned at the maximum radius portion, so that the switch lever 71 rotates in a direction A, and the pressure pin 71*a* moves toward the platen 7 (see, for example, FIG. 23D). In the case of a ribbon cassette with the delay lever 805 (utilizing a two-color ribbon or a self-correction ribbon), said pressure pin 71*a* presses the delay lever 805 toward the platen 7 so that the delay roller 804 is brought into contact with the platen 7 (see, for example, FIG. 9).

In the head-up motion the motor 502 is inversely rotated to rotate the head cam 516. Thus the switch slider is disengaged from the maximum radius portion of the switch cam 517, so that the switch lever 71 rotates in a direction B shown in FIG. 4, and the delay lever 805 is freed from said pressure pin 71*a* and returns to the initial position.

Thus the present embodiment can improve the recording speed as the delay lever 805 can be advanced or retracted regardless of the position of the carrier 50 in the recording area.

As explained in the foregoing, the up-down motions of the head, ribbon winding, advancement and retraction of the switch lever are conducted in the course of movement of the carrier 50, and, in the present embodiment all these operations are controlled by a predetermined amount of inverse rotation of the motor 502.

In the following there will be explained the paper feeding operation.

The rotation of the motor 502 on the carrier 50 is transmitted to the bevel gear 507 so that said gear is constantly rotated in synchronization with said motor 502.

Figure 12A:
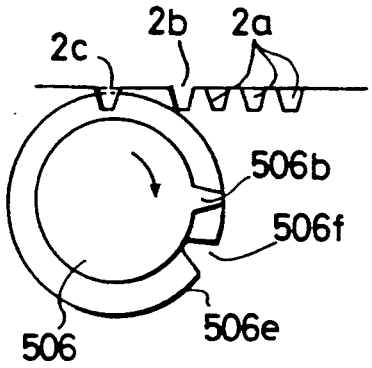
FIGS. 12A, 12A', 12B, 12B' and 12C are schematic views showing the function of a carrier pinion and a sheet feeding mechanism in an embodiment of the present invention.
Figure 12A:
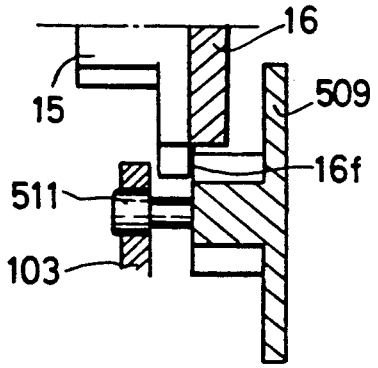
Figure 12B:
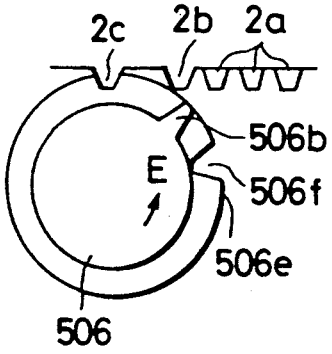
Figure 12B:
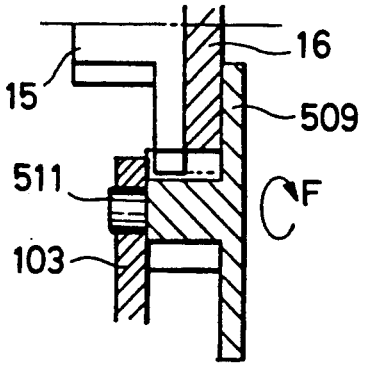
Figure 12C:
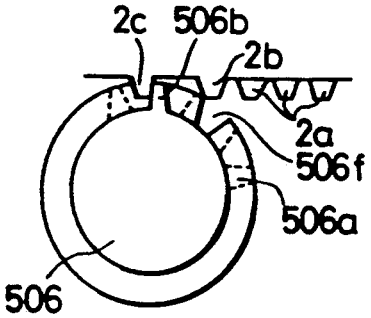

When the motor 502 is inversely rotated by a signal from the CPU, the carrier 50 moves toward the home position (at left in the drawing) while rotating the bevel gear in a direction C. In this operation at first the ratchet gear 509*a* meshes with the shutter gear 16 thereby rotating said shutter gear in a direction D. In this state the ratchet gear 509*a* is in contact with the tooth faces 16*e* of the shutter gear 16, and the meshing becomes deeper in the direction of thickness with the movement of the carrier 50, until if reaches the abutting face 16*f*. Since the shutter gear 16 is frictionally braked by the friction spring 17, the teeth of the ratchet gear 509 are in constant contact with the tooth faces 16*e* of the shutter gear. As the carrier 50 moves further, the ratchet spring 510 is so that the ratchet gear 509 and the ratchet plate 508 move on the bevel gear shaft 507*b* of the bevel gear 507, but the rotating force is transmitted by the key groove 507*c* (FIG. 12A'). On the other hand, the carrier pinion 506 is disengaged from the stop tooth 2*b* of the rack 2, and the guide ring 506*e* rotates in contact with said stop tooth 2*b* (FIG. 12A). Immediately before the carrier pinion 506 is disengaged from the stop tooth 2*b*, the contacts 21*a*, 21*b* of the switch 21 are pressed by the projection 501*b* of the carrier 50 to close said switch. Therefore the arrival of the carrier 50 at a predetermined position can be detected by the closing of said switch 21. In response to the closing of said switch 21, the motor 502 is inversely rotated by a predetermined amount, whereby the carrier 50 is stopped when the carrier pinion 506 is disengaged from the stop tooth 2*b*. However the carrier pinion 506 can rotate further Then the carrier pinion 506 is stopped at a predetermined position, and the motor is rotated forward to rotate the carrier pinion 506 in a direction E (FIG. 12B). The motor is stopped before the stop tooth 2*b* engages with the notch 506*f* (FIG. 12B). In this operation, the ratchet gear 509, rotating in a direction F, slides on the abutting face 16*f* of the shutter gear 16, then passes between the feed gear teeth 16*a* and meshes with the teeth of the paper feed gear 15 (FIG. 12B'). In this operation, the ratchet plate 508 also moves, following the ratchet gear 509. As the meshing between the paper feed gear 15 and the ratchet gear 509 increases the load of the latter, the claws 508*a*–508*d* of the ratchet plate 508 are disengaged from the ratchet teeth 509*c* of the ratchet gear 509, thus releasing the rotating force of the motor 502. The ratchet plate 508 releases the force in the direction F but transmits the force in the direction C. Thus, by inversely rotating the motor 502 in response to a signal from the CPU while the ratchet gear 509 meshes with the paper feed gear 15, the rotating force is transmitted through the paper feed gear 15, pressure gear 18 and paper feed roller gear 11 to rotate the paper feed roller 4, thereby advancing the printing sheet S by the friction between said sheet and the paper feed rubber roller 5. After the feeding of the sheet S by a predetermined amount, the motor 502 is rotated in the forward direction by a signal from the CPU, whereby the ratchet 508 is disengaged so that the paper feed gear 15 no longer receives the rotating force of the motor 502. Consequently the paper feed roller does not rotate inversely, and the carrier pinion 506 rotates in a direction G. Thus, after the start tooth 2*c* of the rack 2 comes into contact with the synchronization tooth 506*b*, the rack teeth 2*a*meshes with the pinion teeth 506*a* to start the motion of the carrier 50 toward the right (FIG. 12C). With said motion of the carrier 50, the paper feed gear 15 and the shutter gear 16 are disengaged from the ratchet gear 509, and, in said disengagement, the ratchet 508 is in action to release the rotating force. As the stop ring 511 pressed in the bevel gear 507 is fitted in the guide hole 103*a* of the left side plate 103, it is rendered possible to maintain an exact distance between the paper feed gear and the ratchet gear 509 during their mutual meshing. In the present embodiment the amount of paper feed at a time is limited by a rotation of the carrier pinion 506. Thus a larger amount of paper feed can be achieved, without the motion of the carrier 50, by alternating the inverse and forward rotations of the motor 502, thus consecutively effecting paper feeds. In such repeated inverse and forward rotations of the motor 502, there is generated a backlash in the transmission system from the motor pinion 503 to the paper feed gear 15. In order to compensate such backlash, the paper feeding at the inverse rotation of the motor is conducted by a number of pulses larger by a predetermined number than that calculated from the gear ratio. Said backlash compensation is always conducted before each paper feeding by the inverse rotation of the motor 502.

As explained in the foregoing, the present embodiment allows utilization of the driving force of the motor 502 also for feeding the printing sheet S, and can therefore provide more compact and lighter equipment.

The pressure gear 18 is constantly pressed, by the pressure spring 20, to the paper feed gear 15 and the paper feed roller 11, thus preventing the backlash. Also the pressure gear 18 is positioned in a direction to be biased by the pressure spring pulled by the paper feed gear 15 in the high-load paper feeding operation, so that the pressure spring 20 can be of a weak spring force and the increase in the load of the motor 502 is limited.

In the following there will be explained the initializing operation of the printer at the start of power supply.

Figure 14:
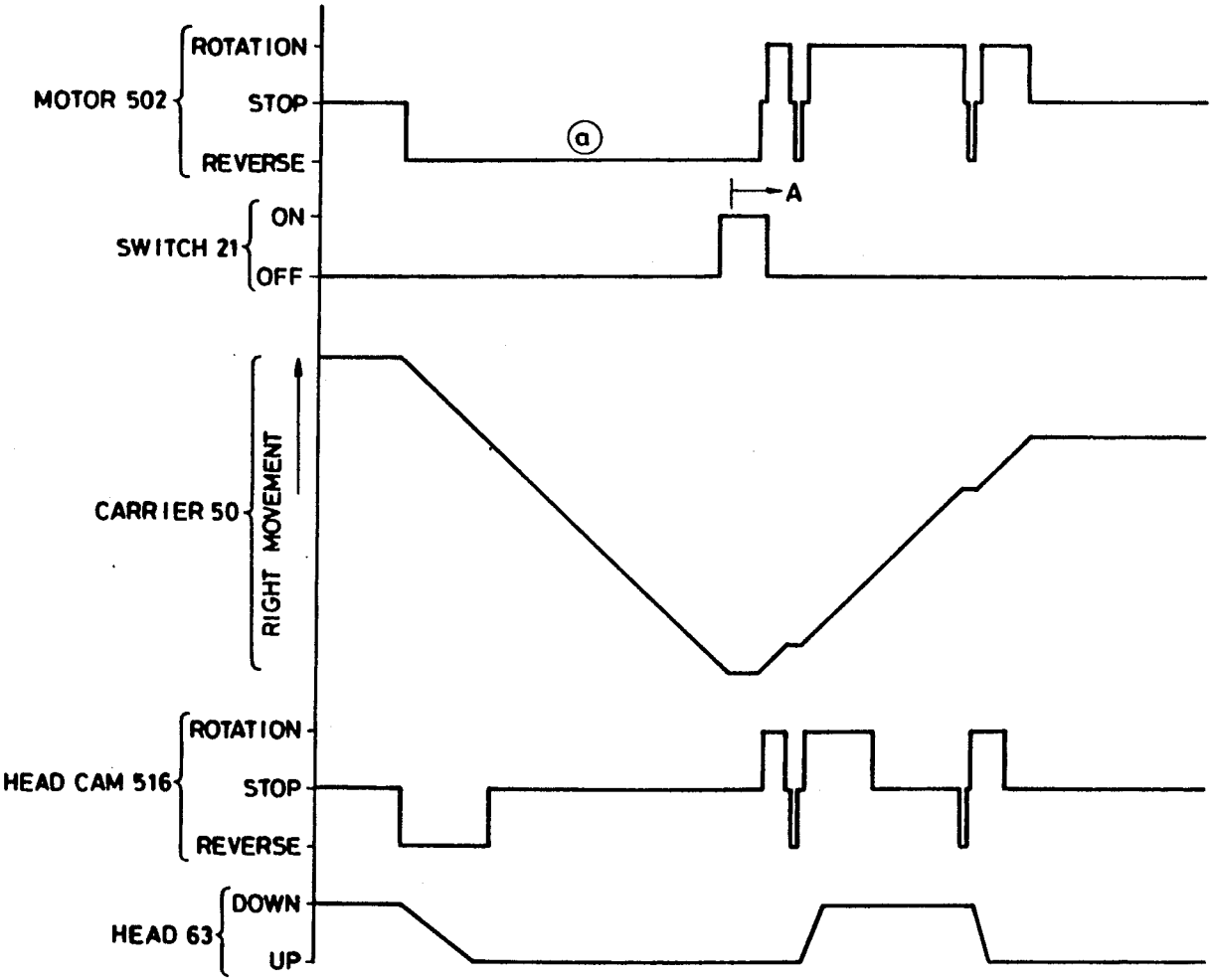
FIG. 14 is a timing chart showing a carrier initializing process.

FIG. 14 is a timing chart of said operation.

At first, if the switch 21 is turned off, the motor 502 of the carrier 50 is inversely rotated to return the carrier 50 to the home position If the printing head 63 is in the down position, said inverse rotation of the motor 502 causes an inverse rotation of the head cam 516 whereby the printing head 63 is separated from the platen 7. When the stop cam 518*c* of the ribbon feed cam 518 comes into contact with the ribbon lever arm 76*b* of the ribbon lever 76, the clutch spring 515 is released to terminate the rotation of the head cam 516. In this state the center gear 504 and the carrier 50 continue to move.

When the projection 501*b* of the carrier 50 presses the contact 21*a*, the switch 21 is closed to stop the carrier 50 after a predetermined speed slowdown. Then the carrier 50 is moved in the forward direction and is stopped with the index at the first digit position by rotating the motor 502 with a predetermined number of pulses after the detection of the opening of the switch 21. In the meantime the printing head 63 is shifted down and up, thus taking up the slack in the ribbon R. On the other hand, if the switch 21 is closed when the power supply is started, the carrier 50 is moved to the right to the first digit position, with the above-mentioned slack take-up operation after the detection of opening of the switch 21. In this case, therefore, the procedure starts from a point (A) in FIG. 14.

Figure 15:
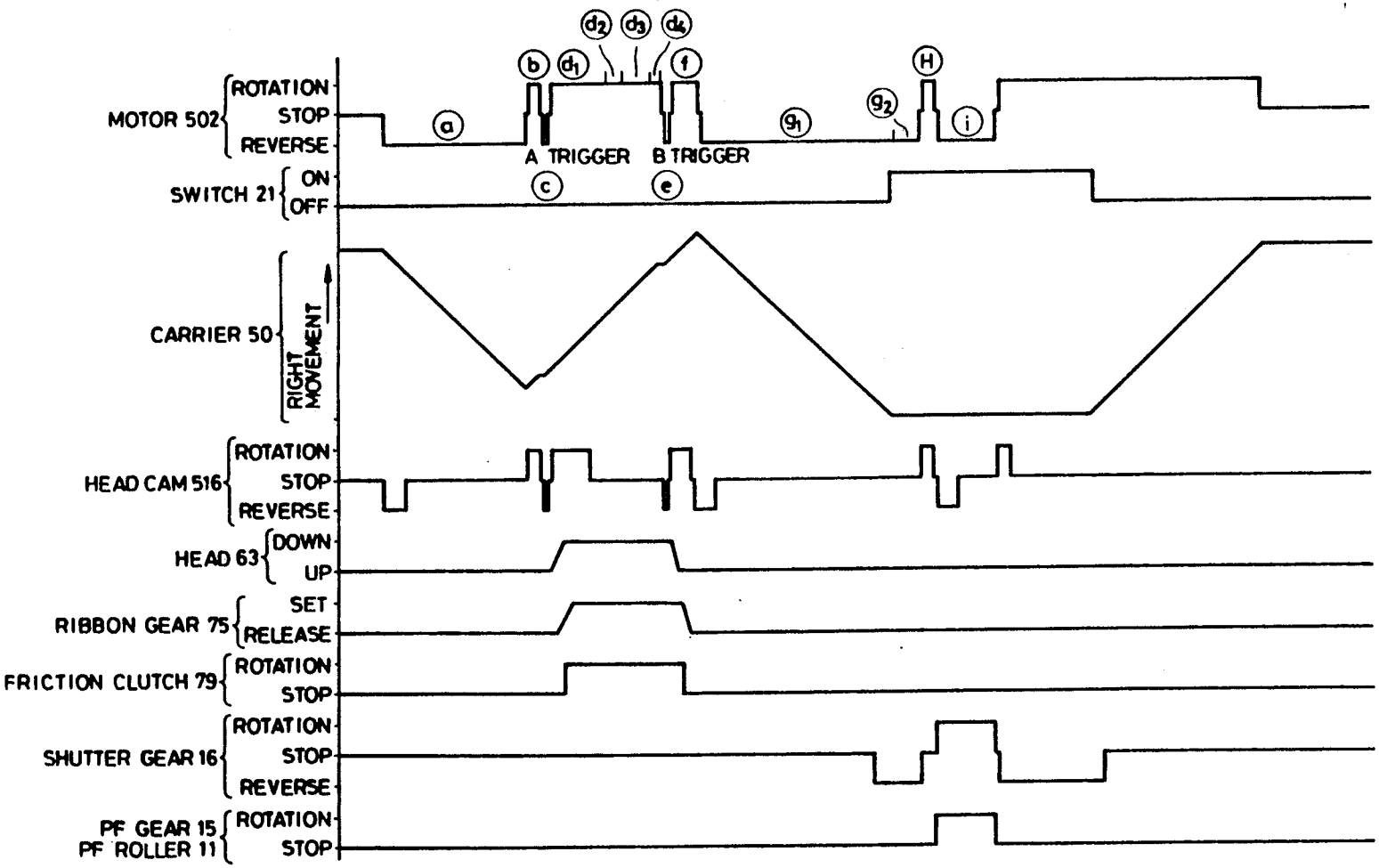
FIG. 15 is a timing chart showing the entire function of a printing operation constituting an embodiment of the present invention.

In the following there will be explained the printing operation, of which timing chart is shown in FIG. 15.

Figure 16B:
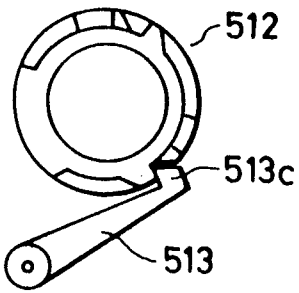
FIGS. 16A and 16B are schematic views showing the function of the control plate.
Figure 16A:
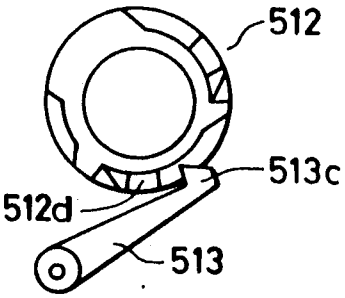

When the power switch 1014 is turned on, there is executed the above-explained initializing procedure for the printer, and the carrier 50 stops at the first digit position. The printing operation is started by entering characters or symbols from the keyboard 1015 (FIG. 13), followed by the actuation of a return key. At first the motor 502 is inversely rotated to return the carrier 50 by a predetermined amount (a). Then the carrier 50 is moved to the right by a predetermined amount (b) to cause the control lever 513 to engage with the control cam 512 at the position B, and there is started the inverse rotation (trigger motion) of the motor 502 (c), thus lowering the printing head 63. During the returning motion of the carrier 50, the relation of the control lever 13 and the control cam 512 is defined by the contact of the stop cam 518*c* of the ribbon feed cam 518 and the ribbon arm 76*b* as explained before, so that, as shown in FIG. 16A, the claw 513*c* stands by immediately in front of the inclined face 512*d* of the control cam 512. Then a forward rotation in a stage b brings the control cam 512 in contact with the control lever 513, thus enabling a trigger motion (FIG. 16B). Then a reverse rotation of the motor 502 in a stage c effects a head-down motion (d). More specifically, the head-down motion is completed at $d_1$, then a preliminary running is effected at $d_2$, and a printing operation is conducted at $d_3$ by a voltage supply to the printing head. Then a follow-up running after printing is done at $d_4$ to complete the printing operation.

The cams of the head cam 516 are so designed that the head-down motion is conducted slowly with sufficient time that the friction clutch starts to rotate after the printing head 63 has come into contact with the platen 7 and the supply of the ribbon R has started, in order to prevent smear at the initial part of the printing.

Then the motor 502 is reversed (trigger B) at a stage e to shift up the printing head at f. In this operation the winding of the ribbon R is stopped after the shift-up motion of the printing head 63, so that the ribbon R pulled out in the shifted down state of the printing head can be taken up to prevent slack in the tape. The smear at the rear end of printing can also be prevented since the printing head is shifted up instantaneously.

After the head-up motion, the carrier 50 is moved to the left (stage $g_1$), and the motor is further rotated by a predetermined amount (stage $g_2$) after the detection of closing of the switch 21. In this state the carrier 50 is already stopped as explained before. Then a forward rotation H disengages the paper feed gear 15 from the shutter gear 16 and causes said paper feed gear 15 to engage with the ratchet gear 509. Then a reverse rotation i of the motor 502 rotates the paper feed gear 15 and the paper feed roller gear 11, thus advancing the printing sheet by a predetermined amount. After said paper feeding operation, the motor 502 is rotated in the forward direction in a stage j, whereby, after rotation of a predetermined amount, the carrier pinion 506 meshes with the rack teeth 2*a* to move the carrier 50 to right, to the first digit position. The ordinary printing operation is conducted in this manner.

Figure 17:
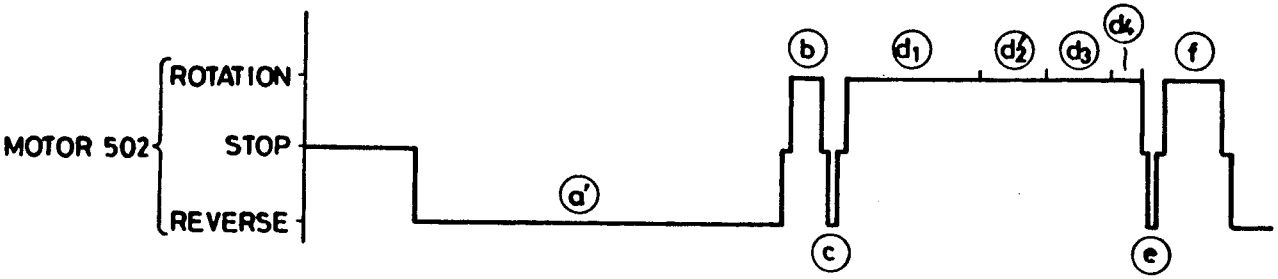
FIG. 17 is a timing chart showing a printing operation with a self-correction ribbon.

In the following there will be explained a printing operation with a first layer of the aforementioned self-correction ribbon or of a so-called two-color ribbon disclosed in the Japanese Patent Applications 260403/1984 or 29883/1985 of the present applicant, wherein a first layer and a second layer are mutually overlaid. In this case the ribbon mode is selected by the keyboard 1015, but it may also be selected by an exclusive selector switch, or by a detecting hole provided on the ribbon cassette and cooperating with a contact provided on the carrier. For the printing operation with the first layer, for example in black color, of the self-correction ribbon or the two-color ribbon, the ribbon R has to be separated from the sheet S with a steep angle after the heating with the printing head 63. In consideration of the eventual fluctuation in the timing of winding of the ribbon R, the slack in the ribbon R pulled out by the printing head 63 is taken up with increased running $d_2$ after the head-down motion. FIG. 17 shows a timing chart of the motor 502 in this case. It is different from the timing chart shown in FIG. 15 only in the carrier return stage a' and the head-down state d2'.

Figure 19A:
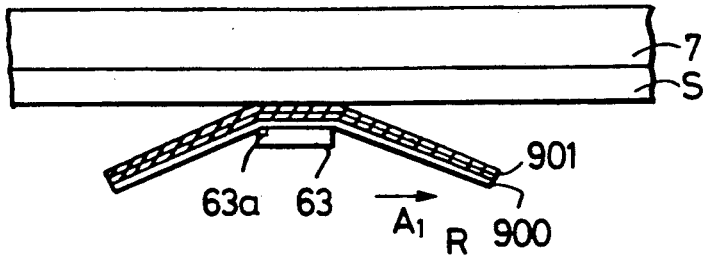
FIGS. 19A and 19B are schematic views showing the states of peeling of printing ribbon from the recording sheet at the printing operation.
Figure 19B:
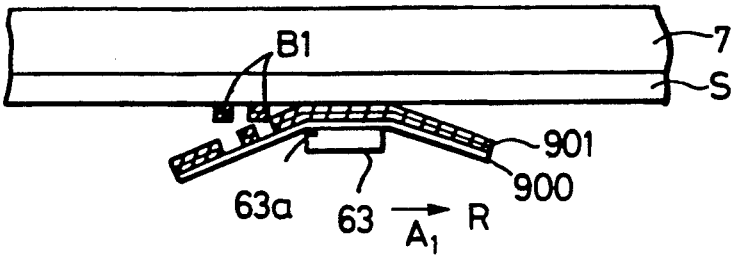

FIGS. 19A and 19B illustrate the printing operation in this state.

In these drawings there are shown a substrate 900 of the ink ribbon R; multiple ink layers 901; a heating portion 63*a* of the printing head 63; and a recorded image B1.

Figure 18:
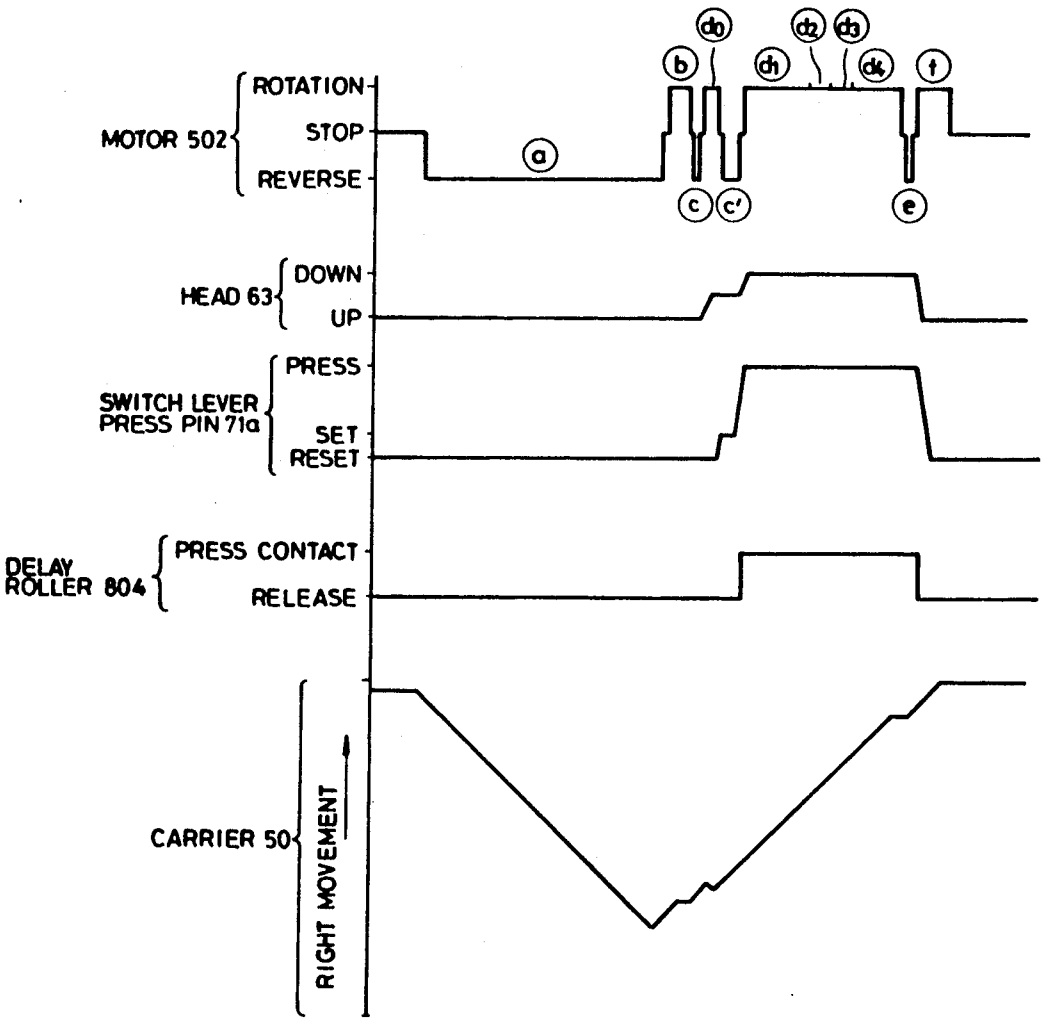
FIG. 18 is a timing chart showing an erasing operation with the self-correction ribbon.

Now reference is made to a timing chart shown in FIG. 18 for explaining the correction operation with a self-correction ribbon.

At first the erasure key of the keyboard 1015 is actuated to reverse the motor 502 (stage a) thereby returning the carrier 50. Then the control lever 513 is set in a stage b, and the motor 502 is reversed in a stage c (trigger A) to initiate the head-down motion. As the switch slider 72 reaches the position of the switch groove 517*b* of the head cam 516 in a stage $d_0$, the motor 502 is reversed in a stage c' (trigger C) for rotating the switch lever 71. Since the amount of said reverse rotation c' of the motor 502 is larger than that of the reverse rotation c or e (trigger A/B) in the head-up or head-down motion, the carrier 50 is slightly moved in the opposite direction, but such movement does not unfavorably affect the printing operation as the printing head 63 is not yet pressed to the platen 7. Said reverse rotation of the motor 502 (trigger C) causes a slight rotation of the switch lever 71, whereby the switch slider 72 falls on the switch cam face 517*c* to complete the setting.

Figure 20A:
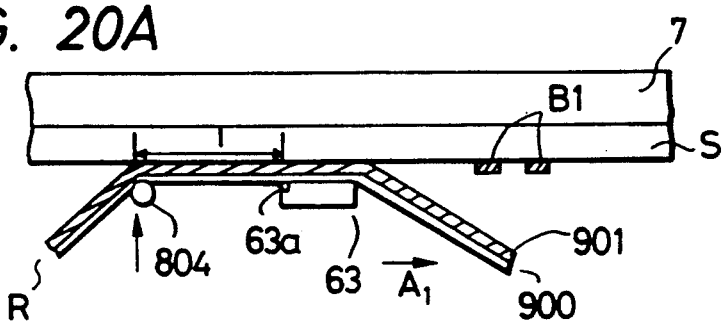
FIGS. 20A and 20B are schematic views showing the states of peeling of printing ribbon from the recording sheet at the erasing operation.

Then, by the forward rotation of the motor 502 in a stage $d_1$, the printing head 63 continues to be shifted down and is pressed to the platen 7. At the same time the switch lever 71 and the pressure pin 71*a* are also rotated to press the slider 809 of the ribbon cassette 80, thereby pressing the delay roller 804 by means of the delay lever 806 to the platen 7 (see, for example, FIG. 20A).

Figure 20B:
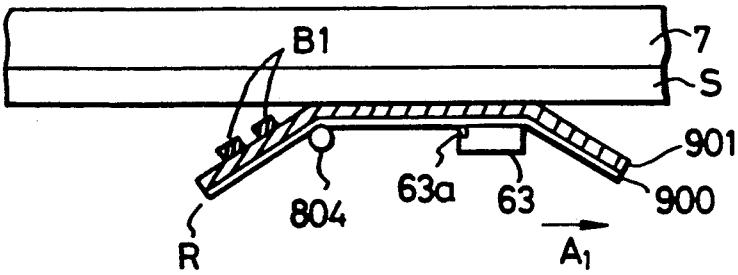

Then the heating portion 63*a* of the printing head 63 is activated in the printing position B1 to half melt the ink, and the printing portion B1 is peeled off from the sheet S in a stage $d_3$ (see, for example, FIG. 20B). The run $d_4$ is longer than in the printing operation with the self-correction ribbon, since it has to be continued until the delay roller 804 passes through the printing portion B1.

Subsequently the motor 502 is reversed in a stage e (trigger B) to elevate the printing head 63 in a stage f. Simultaneously the switch lever 71 is reset, thereby releasing the delay roller 804 from the platen 7. The above-explained correction operation is conducted only once, but it may be repeated once more in consideration of the smoothness of space of the sheet S.

In the case of a printing operation with the ink, for example blue, of the second layer of the aforementioned two-color ribbon, the delay lever 804 is advanced to delay the peeling of the ribbon R from the sheet S after the printing operation as in the erasing operation with the self-correction ribbon, and can be conducted with same timing as in the erasing operation. More specifically, the reverse rotation of the motor 502 at the head-down motion is conducted in stage c (trigger A) and c' (trigger C) to press the delay roller 804 to the platen 7, thereby delaying the timing of peeling of the ribbon R from the sheet S.

As explained in the foregoing, the present embodiment achieves the up-down motions of the printing head and the reciprocating motion of the carrier supporting said printing head by means of a common motor, thereby providing a compact, light and inexpensive printer.

Figure 24:
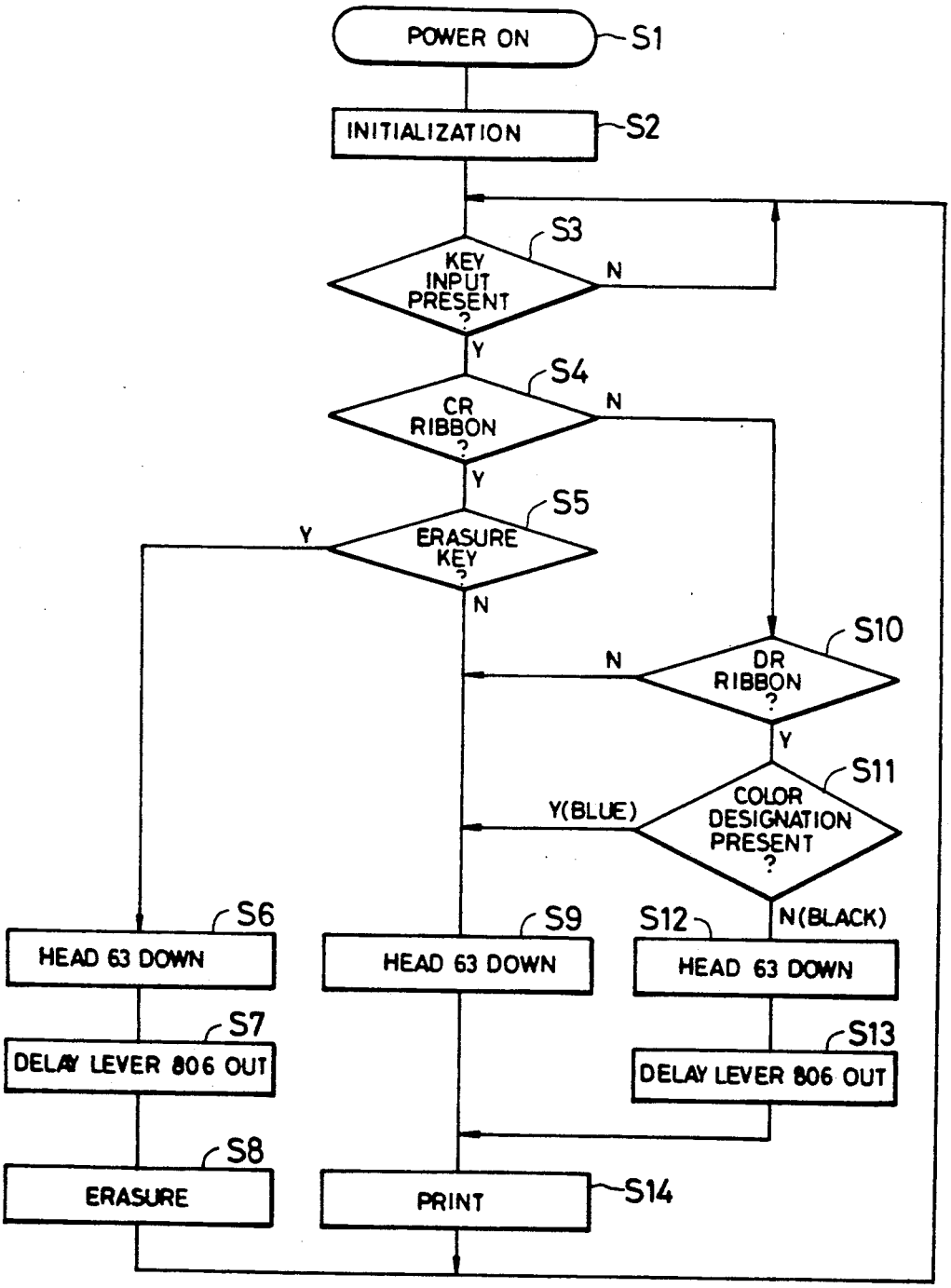
FIG. 24 is a flow chart of the output unit.
Figure 25:
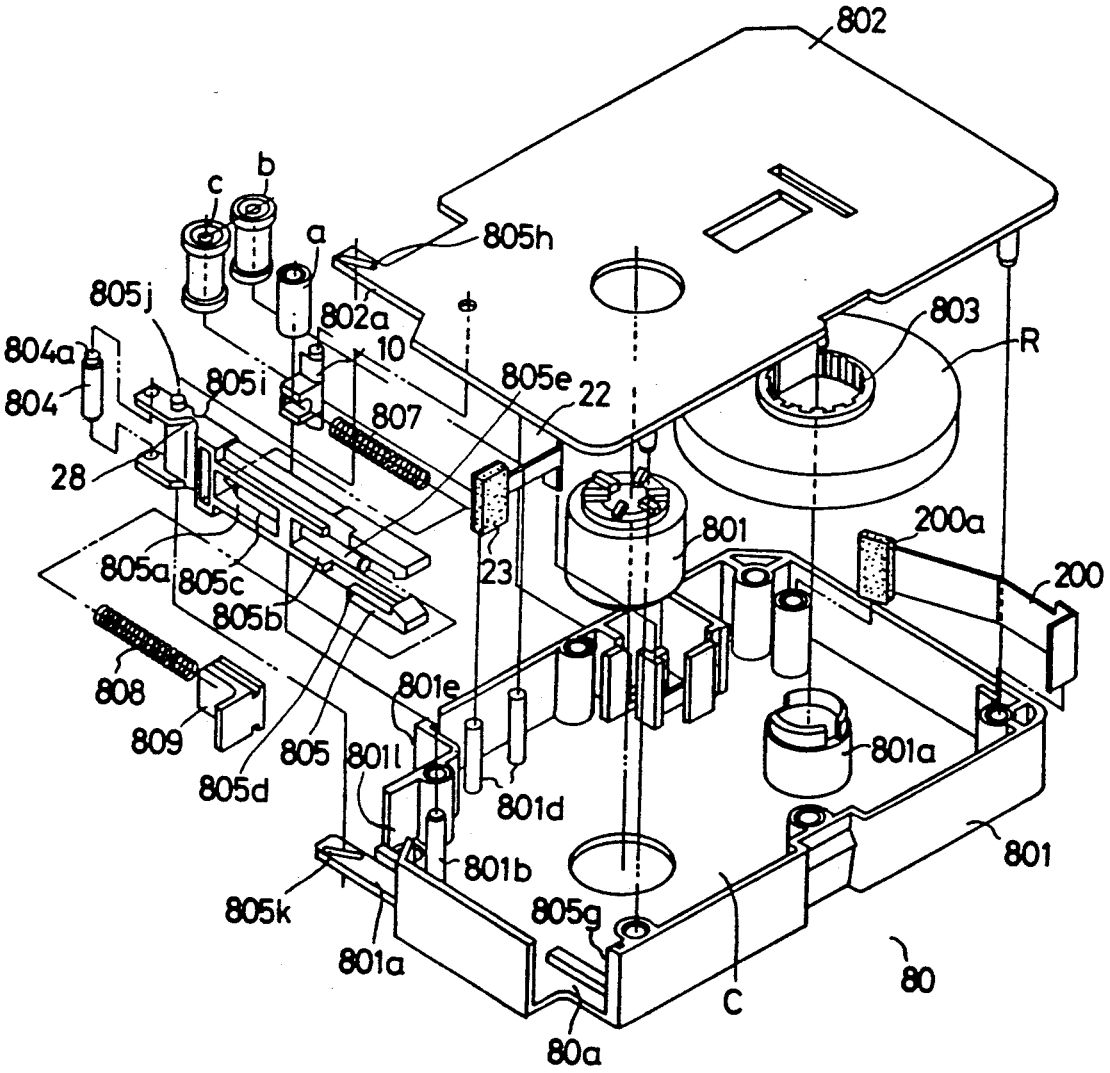
FIG. 25 is an exploded perspective view of an ink ribbon cassette.

In the following there will be explained the control of the output unit by a program stored in the aforementioned ROM. FIG. 24 shows a flow chart of the control of the delay lever of the ribbon cassette. As explained in the foregoing, said output unit is equipped with a thermal printer capable of printing in two colors, can be loaded, on the carrier 50, with a single-color ribbon, a two-color ribbon capable of printing two colors with the same ribbon, or a self-correction ribbon, and is further capable of selecting the printing color in the case of the two-color ribbon.

In the present embodiment, the color information can be a ribbon identification signal or a color selection signal entered from the keyboard.

After the start of power supply in a step S1, a step S2 executes an initialization process such as a head-up motion. Then a step S3 investigates the presence of a key input. Said step is repeated in the absence of a key input. On the other hand, in the presence of a key input, a step S4 discriminates the loaded ribbon, and, if it is not a correctable ribbon CR, the sequence proceeds to a step S10. If it is a correctable ribbon, a step S5 identifies the key input in the step S3, and, if it is the erasure key, the sequence proceeds to a step S6. If not, a step S9 executes a head-down motion, then a step S14 executes a printing operation and the sequence returns to the step S3 for again awaiting the key input.

On the other hand, if the step S5 identifies that the key input is the erasure key, the step S6 executes a head-down motion, then a step S7 advances the delay lever, and a step S8 executes the erasing operation. Subsequently the sequence returns to the step S3 to await the key input.

When the step S4 identifies that the loaded ribbon is not a correctable ribbon, the sequence proceeds to a step S10 to discriminate whether the loaded ribbon is a dual color ribbon DR, and, if not, the sequence proceeds to a step S9. If it is a dual color ribbon, a step S11 discriminates whether a color printing is selected. The sequence proceeds to a step S9 for blue printing if the color printing is selected, or to a step S12 for black printing if the color printing is not selected. The step S12 shifts down the printing head 63, then a step S13 advances the delay lever 806, and a step S14 executes a printing operation. Subsequently the sequence returns to the step S3 to again await the key input.

As explained in the foregoing, the present embodiment achieves recording and correction with a self-correction ribbon, or blue recording and black recording with a dual color ribbon.

Now reference is made to FIGS. 8, 9, 25, 26A, 26B and 26C for explaining the detailed structure of the ink ribbon cassette, which may be loaded with a self-correction ribbon or a two-color ribbon as explained before.

Then reference will be made to FIGS. 11A, 11B, 12A, 12A', 12B, 12B' and 12C for explaining the function of said ink ribbon cassette.

The aforementioned ink ribbon cassette 80 incorporates the ink ribbon R in a case c composed of a lower case 801 and an upper case 802, and is detachably mounted on the carrier cover 70.

The ink ribbon R is wound on a core 803 fitted on a projection 801*a* of the lower case 801. Said ink ribbon R travels along rollers a, b, c respectively rotatably mounted on a projection 801*b* of the lower case 801, an ink ribbon detection window 801*c* and a projection 801*d* of the lower case, then is exposed to the outside of the case c at an aperture 801*c* of the lower case, then guided by the delay roller 804, again enters the case c through an aperture 801( and wound on a take-up hub 810.

When said cassette 80 is loaded on a predetermined position of the carrier cover 70, said aperture 801*e* of the cassette is positioned opposite to the printing head 63 of the printer, whereby the ink ribbon R exposed to the outside of the cassette case c can be heated by the printing head 63 for generating heat according to the information to be recorded. The ink ribbon R is biased toward the roller a by means of a spring 200 provided on the lower case 801. Said spring 200 is provided with a piece of felt 200*a*, in order to avoid damage on the ink ribbon R by contact.

A tension spring 201 biases the ink ribbon R in a direction J, thus taking up the slack thereof. Said tension spring 201 is provided on the lower case 801 and resiliently presses the ink ribbon R at the upstream side of the rollers b, c with respect to the advancing direction of said ribbon R. The elastic force of said tension spring can therefore rapidly absorb the eventual slack in the ribbon R when the path thereof is changed by a movement of the delay roller 804 caused by the movement of the delay lever 805, so that the ribbon R will not be left in a slack state. Said tension spring 201 is also provided with a piece of felt 201*a* on a face contacting the ink ribbon R, in order to prevent damage thereon. Said felt may however be replaced by a suitable coating provided on the surface of the tension spring 201.

The delay lever 805 is provided slidably, as indicated by arrows C1, C2, along a lateral end 80*a* of the cassette 80, having the aperture 801*e*, and is rendered slidable, guided by an end portion 802*a* of the upper case 802 and an end portion 801*a* of the lower case 801. At the front end of said lever 805, the delay roller 804 is rotatably mounted on a shaft 804*a*. Said lever 805 is further provided with an upper aperture 805*a* and a lower aperture 805*b*. A projection 801*f* of the lower case is fitted in said upper aperture 805*a*, and a return spring 807 is provided along a guide rod 805*c* and between said projection 801*f* and the lever 805. Consequently the lever 805 is biased downwards, in a direction C2, by the resilient force of said spring 807. In said lower aperture 805*b* there is provided the slider 809, which is rendered slidable along a guide 805*d* and with respect to the lever 805. A spring 808 is provided along a guide rod 805*e* fixed to the lever 805, and between said lever 805 and slider 809 to bias the slider 809 downwards, in a direction C2, so that the slider 809 is stopped by a stopper portion 805*g* of the guide 805*d*.

Said delay lever 805 is provided with an upper guide 805*j* and an unrepresented lower guide pin, respectively guided by a delay lever upper guide 805*h* (slits L) provided on the upper case 802 and a delay lever lower guide 805*k* provided on the lower case 801. Said delay lever 805 is further provided with a hinge portion 805*i* of a reduced thickness, so that said delay lever can freely bend about said hinge portion. The delay lever 805 is composed of a resin material with a relatively high bending resistance such as polypropylene, polyethylene or polyacetal. Consequently the delay lever bends at said hinge portion 805*i* and can move diagonally upwards along the guides 805*h*, 805*k* beyond said hinge portion 805*i*. The upper and lower guides 805*h*, 805*k* are positioned in an inclined manner.

In the present embodiment, when the switch lever 71 of the printer rotates clockwise thereby engaging with the slider 809 of the pressure pin 71*a* and pushing up the slider 809, the lever 805 is pressed in a direction C1 toward the platen 7, against the biasing force of the return spring 807. Thus the lever 805 is bent about the hinge 805*i* and protrudes diagonally upwards along the slits L. After the lever 805 is brought into contact with the platen 7 across the ink ribbon R and the printing sheet S, the slider 809 is pressed toward the platen 7 against the biasing force of the spring 808, and the lever 805 remains pressed to the platen 7 by the biasing force of the spring 808.

Consequently, after the heating, the ink ribbon R is not separated from the printing sheet S until the position of the delay roller 804, and is peeled off from the sheet S after passing the delay roller 804.

In the present embodiment, as explained in the foregoing, the delay roller 804 is lightly pressed to the platen 7 by the elastic force of the spring 808, and the resulting stable contact force prevents smear in the recording caused by offsetting, or an error in the feeding of ink ribbon such as wrinkles or diagonal movement.

On the other hand, when the switch lever 71 of the printer rotates counterclockwise to retract the pressure pin 71*a*, the slider 809 is not pushed up but remains retracted by the biasing force of the return spring 807. Consequently the delay roller 804 remains separated from the platen 7, and the ink ribbon R is separated from the printing sheet S soon after passing the end of the thermal printing head 63. In the thermal printing head 63 of the present embodiment, the distance from the heating portion 63*a* to the peeling position of ink ribbon is approximately 250 μ which is shorter than in an ordinary thermal head. The printing of the second color with a two-color ink ribbon and the printing with a self-correction ribbon can be achieved by peeling the ink ribbon with a peeling angle of about 40° to 60°.

Figure 26A:
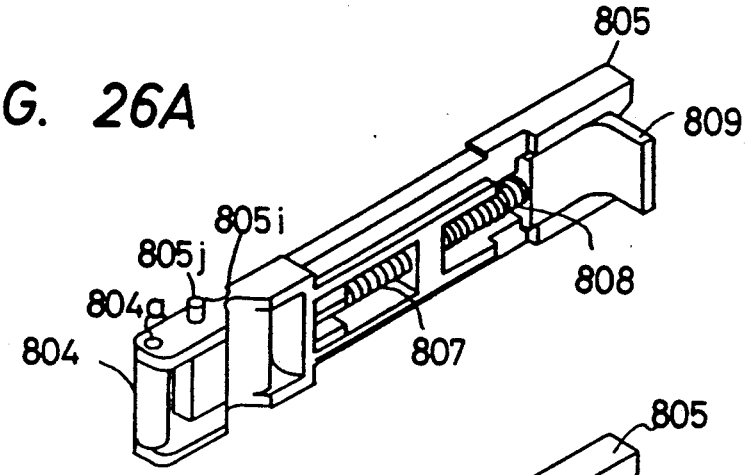
FIGS. 26A, 26B and 26C are perspective views of a delay lever.
Figure 26B:
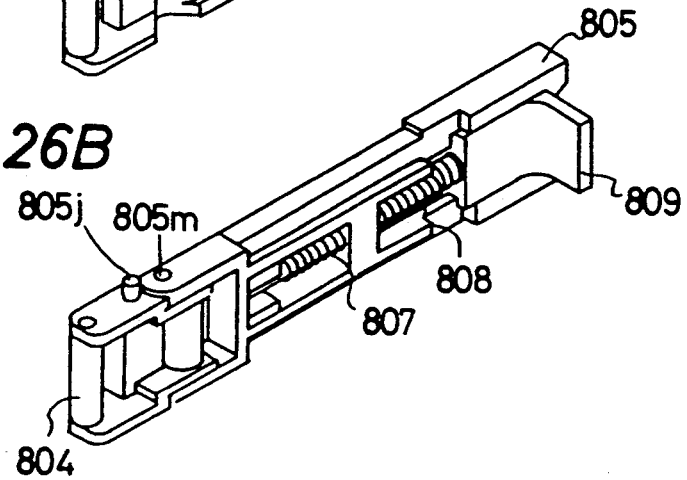
Figure 26C:
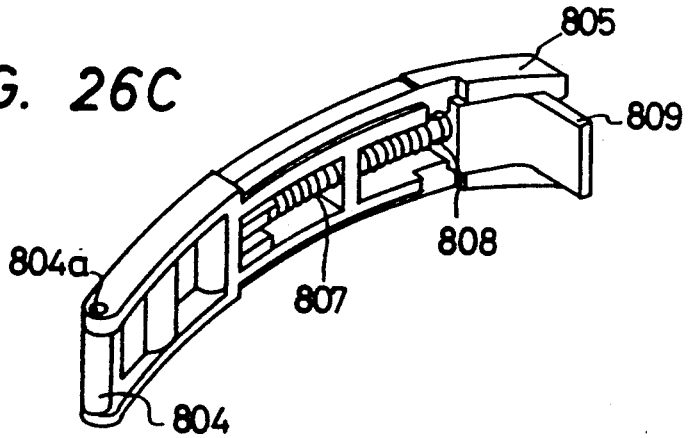

FIGS. 26A, 26B and 26C are magnified perspective views of the delay lever.

FIG. 26A shows the delay lever of the foregoing embodiment while FIGS. 26B and 26C show other embodiments. In the embodiment shown in FIG. 26B, the delay lever 805 is divided into a front portion A and a rear portion B mutually rotatably connected by a delay lever shaft 805*m* instead of the aforementioned hinge portion. Also this structure allows movement of the guide pin 805*j* along the slits L, so that the delay lever can proturude in the diagonal direction. FIG. 26C shows another embodiment in which the delay lever 805 is formed as a curved member, whereby said delay lever can protrude in a diagonal direction without the slits L.

As explained in the foregoing, these embodiments allow the delay lever to protrude in the diagonal direction, so that the distance for ink ribbon peeling can be increased within a limited space and the ink transfer speed can be increased.

As explained in detail in the foregoing, these embodiments are provided with pressure member driving means for displacing the pressure member between an action position in pressure contact and a retracted position at an arbitrary point of the recording process, thereby enabling rapid displacement of the pressure member in any position in the recording area, thus increasing the recording speed.

As explained above, the present invention obtains a compactized printer.

What is claimed is:

1. A printer comprising:

a recording head for recording on a recording sheet;

support means capable of reciprocating motion along a transport path of said recording sheet for supporting said recording head in such a manner that said recording head is capable of up-down motion;

ink sheet winding means for winding an ink sheet having ink thereon;

recording sheet transport means for transporting said recording sheet;

a motor provided on said support means rotatable in forward and reverse directions;

control means for controlling the forward and reverse rotation of said motor;

first drive transmission means for moving said recording head from an up-position to a down-position and from a down-position to an up-position in response to the rotation of said motor once in a reverse direction and then in a forward direction;

second drive transmission means for driving said winding means in response to rotation of said motor; and third drive transmission means for driving said recording sheet transport means in response to rotation of said motor, wherein said first drive transmission means is capable of moving said recording head between the up-position and the down-position at any point along the transport path and said support means is stationary when said motor moves once in a reverse direction.

2. A recording apparatus for image recording on a recording medium, comprising:

a carrier capable of reciprocating motion along the transport path of said recording medium;

recording means provided on said carrier for image recording on said recording medium, capable of being displaced between a recording position for recording on said recording medium and a position retracted from said recording position;

a motor provided on said carrier rotatable in forward and reverse directions;

control means for controlling the forward and reverse rotation of said motor;

first drive transmission means for moving said carrier along the transport path of said recording medium in response to the forward and reverse rotation of said motor;

second drive transmission means comprising a one-directional clutch for moving said recording means between said recording position and said retracted position in response to the forward and reverse rotation of said motor;

wherein said motor is once reverse rotated in a trigger rotation and then forward rotated to displace said recording means to said retracted position, and wherein said second drive transmission means is capable of moving said recording means between the recording and retracted positions at any point along the transport path and said carrier is stationary when said motor is once reverse rotated in a trigger rotation.

3. A recording apparatus for image recording on a recording medium, comprising:

a carrier capable of reciprocating motion along the transport path of said recording medium;

recording means provided on said carrier for image recording on said recording medium, capable of being displaced between a recording position for recording on said recording medium and a position retracted from said recording position;

a motor provided on said carrier rotatable in forward and reverse directions;

control means for controlling the forward and reverse rotation of said motor;

first drive transmission means for moving said carrier along the transport path of said record medium in response to the forward and reverse rotation of said motor; and second drive transmission means for moving said recording means between said recording position and said retracted position in response to the rotation of said motor once in a reverse direction and then in a forward direction, said second drive transmission means capable of moving said recording means between said recording and retracted positions at any point along the transport path and said carrier is stationary when said motor moves once in a reverse direction.

4. A recording apparatus according to claim 3, wherein said second drive transmission means comprises a one-directional clutch.

5. A recording apparatus according to claim 3, wherein said second drive transmission means is driven by said motor in a trigger rotation.

6. A recording apparatus according to claim 3, wherein said first drive transmission means has a backlash larger than an amount of trigger rotation required in the displacement of said recording means to said recording or retracted position.

7. A recording apparatus according to claim 3, wherein the trigger rotation for displacing said recording means to said recording position is conducted within a range of backlash of the gear train of said first drive transmission means.

8. A recording apparatus according to claim 1, wherein rotation of said motor once in a reverse direction and then in forward direction will cause second drive transmission means to move said recording means a) to said recording position when said recording means is at said retracted position, and b) to said retracted position when said recording means is at said recording position.

9. A recording apparatus according to claim 3 wherein said recording means moves between the recording and retracted position in a direction substantially orthogonal to a printing plane of said recording medium.

10. A recording apparatus according to claim 3 wherein said recording means is thermal head.

11. A printer comprising:

a recording head for recording on a recording sheet;

support means capable of reciprocating motion along a transport path of said recording sheet for supporting said recording head in such a manner that said recording head is capable of up-down motion;

ink sheet winding means for winding an ink sheet having ink thereon;

recording sheet transport means for transporting said recording sheet;

a motor provided on said support means rotatable in forward and reverse directions;

control means for controlling the forward and reverse rotation of said motor;

first drive transmission means for moving said recording head between an up-position and a down-position in response to the rotation of said motor once in a reverse direction and then in a forward direction;

second drive transmission means for driving said winding means in response to rotation of said motor; and third drive transmission means for driving said recording sheet transport means in response to rotation of said motor, wherein said support means is stationary when said motor moves once in the reverse direction.

12. A printer according to claim 11, wherein said second drive transmission means drives said winding means to wind said ink sheet only in response to forward rotation of said motor.

13. A printer according to claim 11, wherein said third drive transmission means drives said recording sheet transport means in response to brief forward rotation and then reverse rotation of said motor.

14. A printer according to claim 11, wherein said third drive transmission means comprises:

a driving shaft;

a driving gear movable along the axis of said driving shaft;

a one-directional clutch provided between said driving gear and said driving shaft;

a driven gear meshing with said driving gear; and a shutter gear having notches in the direction of thickness of said driven gear;

wherein said shutter gear and driven gear are constructed concentrically.

15. A printer according to claim 14, further comprising a friction mechanism between said driven gear and said shutter gear.

16. A printer according to claim 11, wherein said recording sheet transport means comprises:

a rotating member;

plural sheet feed members provided on said rotating member and having an arc portion for transporting said recording sheet; and plural guide members provided on said rotating member in spaced manner from said sheet feed members, for guiding said recording sheet.

17. A printer according to claim 11 wherein said third drive transmission means comprises:

a driving gear;

a driven gear receiving power from said driving gear; and an idler gear meshing with said driven gear;

wherein said idler gear has a movable shaft and is pressed to said driving gear and said driven gear by an elastic member.

18. A printer according to claim 17, wherein said idler gear comprises two gears A and B of a same shape with teeth of a same phase, and a cylindrical boss positioned between said gears A and B.

19. A printer according to claim 11, further comprising:

a pressure member positioned at the downstream side of said recording head with respect to the transport direction of said ink sheet and capable of pressing said ink sheet for varying the transport path thereof; and pressure member driving means capable of displacing said pressure member between a contact action position and a position retracted from said contact action position at any time in the recording process.

20. A printer according to claim 19, wherein said pressure member driving means receives driving force from the motor which is used for driving winding means for winding the ink sheet and recording sheet transport means for transporting said recording sheet.

21. A printer according to claim 19, wherein said pressure member driving means is capable of displacing the pressure member at an arbitrary position in the recording direction.

22. A printer according to claim 19, wherein said pressure member is capable of reciprocating in the recording direction integrally with said recording head.

23. A recording apparatus according to claim 11, wherein rotation of said motor once in a reverse direction and then in a forward direction will cause said first drive transmission means to move said recording head a) to said down-position when said recording head is at said up-position, and b) to said up-position when said recording means is at said down-position.

24. A recording apparatus for image recording on a recording medium, comprising:

a carrier capable of reciprocating motion along the transport path of said recording medium;

recording means provided on said carrier for image recording on said recording medium, capable of being displaced between a recording position for recording on said recording medium and a position retracted from said recording position;

motor provided on said carrier rotatable in forward and reverse directions;

control means for controlling the forward and reverse rotation of said motor;

first drive transmission means for moving said carrier along the transport path of said recording medium in response to the forward and reverse rotation of said motor;

second drive transmission means comprising a one-directional clutch for moving said recording means between said recording position and said retracted position in response to the forward and reverse rotation of said motor; and wherein said motor is once reverse rotated in a trigger rotation and then forward rotated to displace said recording means to said retracted position and said carrier is stationary when said motor is once reverse rotated in the trigger rotation.

* * * * *

UNITED STATES PATENT AND TRADEMARK OFFICE

CERTIFICATE OF CORRECTION

PATENT NO. : 5,090,827

DATED : February 25, 1992

INVENTOR(S) : HIRANO ET AL.

It is certified that error appears in the above-identified patent and that said Letters Patent is hereby corrected as shown below:

On the title page, Item:

[56] REFERENCES CITED - FOREIGN PATENT DOCUMENTS:

"2047173 9/1972 United Kingdom ." should read --2047173 11/1980 United Kingdom .--.

COLUMN 1:

Line 48, "view" should read --views--.

COLUMN 2:

Line 42, "self driven" should read --self-driven--.

COLUMN 3:

Line 1, "accomodating" should read --accommodating--;

Line 38, "guide plates 4" should read --guide plates 4a--;

Line 44, "4aof" should read --4a of--;

Line 50, "bend ends 4bof" should read --bent ends 6b of--;

Line 54, "4aand" should read --4A and--.

UNITED STATES PATENT AND TRADEMARK OFFICE

CERTIFICATE OF CORRECTION

PATENT NO. : 5,090,827

DATED : February 25, 1992

INVENTOR(S) : HIRANO ET AL.

It is certified that error appears in the above-identified patent and that said Letters Patent is hereby corrected as shown below:

COLUMN 4:

Line 17, "maniplated," should read --manipulated,--;

Line 37, "15chas" should read --15c has--;

Line 39, "friction spring 7" should read --friction spring 17--;

Line 42, "15cbut" should read --15c but--;

Line 44, "central," should read --central--;

Line 59, "gear," should read --gear 15,--.

COLUMN 5:

Line 56, "bevel gear 507b," should read --bevel gear shaft 507b,--.

COLUMN 6:

Line 18, "having" should read --has--;

Line 44, "(now" should read --(not--.

COLUMN 7:

Line 4, "60eand" should read --60e and--;

Line 17, "71aat" should read --71a at--;

Line 53, "further" should read --is further--.

UNITED STATES PATENT AND TRADEMARK OFFICE

CERTIFICATE OF CORRECTION

PATENT NO. : 5,090,827

DATED : February 25, 1992

INVENTOR(S) : HIRANO ET AL.

It is certified that error appears in the above-identified patent and that said Letters Patent is hereby corrected as shown below:

COLUMN 8:

Line 25, "self correction" should read --self-correction--.

COLUMN 11:

Line 36, "if" should read --it--;

Line 41, "is so" should read --is provided so--;

Line 58, "further Then" should read --further. Then--.

COLUMN 12:

Line 23, "teeth 2ameshes" should read --teeth 2a mesh--;

Line 66, "position If" should read --position. If--.

COLUMN 14:

Line 19, "the" should be deleted;

Line 30, "the heating" should read --heating--;

Line 37, "head-down state d2'." should read --head-down state $d_2$'.--.

UNITED STATES PATENT AND TRADEMARK OFFICE

CERTIFICATE OF CORRECTION

PATENT NO. : 5,090,827

DATED : February 25, 1992

INVENTOR(S) : HIRANO ET AL.

It is certified that error appears in the above-identified patent and that said Letters Patent is hereby corrected as shown below:

COLUMN 16:

Line 38, "aperture 801c" should read --aperture 801e--;

Line 40, "aperture 801(" should read --aperture 801ℓ--; and "wound" should read --is wound--.

COLUMN 18:

Line 16, "proturude" should read --protrude--.

COLUMN 19:

Line 45, "record" should read--recording--.

COLUMN 20:

Line 1, "claim 3," should read --claim 5,--;

Line 6, "claim 1," should read --claim 3,--;

Line 8, "second" should read --said second--;

Line 14, "claim 3" should read -- claim 3,--;

Line 16, "position" should read --positions--;

Line 19, "claim 3" should read --claim 3,--;

Line 20, "thermal" should read --a thermal--.

UNITED STATES PATENT AND TRADEMARK OFFICE

CERTIFICATE OF CORRECTION

PATENT NO. : 5,090,827 Page 5 of 5

DATED : February 25, 1992

INVENTOR(S) : HIRANO ET AL.

It is certified that error appears in the above-identified patent and that said Letters Patent is hereby corrected as shown below:

COLUMN 21:

Line 13, "claim 11" should read --claim 11,--.

COLUMN 22:

Line 8, "recording apparatus" should read --printer--;

Line 24, "motor" should read --a motor--.

Signed and Sealed this

Twenty-sixth Day of October, 1993

Bruce Lehman

*Attest:*

BRUCE LEHMAN

*Attesting Officer*

*Commissioner of Patents and Trademarks*